US009909258B2

(12) United States Patent
Seger et al.

(10) Patent No.: US 9,909,258 B2
(45) Date of Patent: Mar. 6, 2018

(54) MARK AND PAPERMAKING BELT MADE THEREFROM

(71) Applicant: The Procter & Gamble Company, Cincinnati, OH (US)

(72) Inventors: Geoffrey Eugene Seger, Cincinnati, OH (US); John Allen Manifold, Sunman, IN (US); Osman Polat, Montgomery, OH (US); Andrew Paul Frank Milton, Cambridge (GB); Robert Scadding Moir, Arbury Park (GB); Daniel Graham Ward, Cambridge (GB); Richard Bown, Cambridge (GB)

(73) Assignee: The Procter & Gamble Company, Cincinnati, OH (US)

( * ) Notice: Subject to any disclaimer, the term of this patent is extended or adjusted under 35 U.S.C. 154(b) by 83 days.

(21) Appl. No.: 14/932,079

(22) Filed: Nov. 4, 2015

(65) Prior Publication Data

US 2016/0130759 A1 May 12, 2016

Related U.S. Application Data

(60) Provisional application No. 62/076,036, filed on Nov. 6, 2014.

(51) Int. Cl.

| | |
|---|---|
| ***D21F 7/08*** | (2006.01) |
| ***D21H 27/00*** | (2006.01) |
| ***D21F 11/00*** | (2006.01) |

(52) U.S. Cl.

CPC ..... *D21F 7/083* (2013.01); *D21F 11/006* (2013.01); *D21H 27/002* (2013.01)

(58) Field of Classification Search

USPC ..... 162/348, 290, 296, 109, 116

See application file for complete search history.

(56) References Cited

U.S. PATENT DOCUMENTS

| | | | | |
|---|---|---|---|---|
| 5,466,409 | A | 11/1995 | Partridge et al. | |
| 6,420,100 | B1 * | 7/2002 | Trokhan | B05D 1/42 165/116 |
| 6,576,090 | B1 * | 6/2003 | Trokhan | D21F 11/006 162/116 |
| 6,576,091 | B1 * | 6/2003 | Cabell | D21F 11/006 162/116 |

(Continued)

OTHER PUBLICATIONS

PCT International Search Report dated Apr. 8, 2016—4 pages.

*Primary Examiner* — Dennis Cordray
(74) *Attorney, Agent, or Firm* — Andrew J. Mueller

(57) ABSTRACT

A textured mask comprising a film. The film can have a first substantially continuously flat surface lying in a first plane and a second surface opposite the first surface lying in a second plane substantially parallel to the first plane. The second surface is interrupted by a plurality of cavities, each of the cavities having a first depth defined by a third surface lying in a third plane substantially parallel to the first and second planes. The depth of the cavities can be at a distance of from about 0.1 mm to about 5 mm from the second plane. The textured mask is at least partially coated with an opaque masking agent. The textured mask can make a correspondingly structured three-dimensional papermaking belt, which can make correspondingly structured three-dimensional fibrous structure.

11 Claims, 16 Drawing Sheets

(56) References Cited

U.S. PATENT DOCUMENTS

| | | | | |
|---|---|---|---|---|
| 6,660,129 | B1 * | 12/2003 | Cabell | D21F 11/006 162/109 |
| 6,743,571 | B1 * | 6/2004 | Hill | G03F 7/12 430/306 |
| 6,913,859 | B2 * | 7/2005 | Hill | G03F 7/12 264/132 |
| 2008/0245498 | A1 | 10/2008 | Ostendorf et al. | |

* cited by examiner

MARK AND PAPERMAKING BELT MADE THEREFROM

FIELD OF THE INVENTION

The present invention is related to processes for making strong, soft, absorbent fibrous webs, such as, for example, paper webs. More particularly, this invention is concerned with structured fibrous webs, equipment used to make such structured fibrous webs, and processes therefor.

BACKGROUND OF THE INVENTION

Products made from a fibrous web are used for a variety of purposes. For example, paper towels, facial tissues, toilet tissues, napkins, and the like are in constant use in modern industrialized societies. The large demand for such paper products has created a demand for improved versions of the products. If the paper products such as paper towels, facial tissues, napkins, toilet tissues, mop heads, and the like are to perform their intended tasks and to find wide acceptance, they must possess certain physical characteristics.

Among the more important of these characteristics are strength, softness, and absorbency. Strength is the ability of a paper web to retain its physical integrity during use. Softness is the pleasing tactile sensation consumers perceive when they use the paper for its intended purposes. Absorbency is the characteristic of the paper that allows the paper to take up and retain fluids, particularly water and aqueous solutions and suspensions. Important not only is the absolute quantity of fluid a given amount of paper will hold, but also the rate at which the paper will absorb the fluid.

Through-air drying papermaking belts comprising a reinforcing member and a resinous framework, and/or fibrous webs made using these belts are known and described, for example, in the following commonly assigned U.S. Pat. No. 4,514,345, issued Apr. 30, 1985 to Johnson et al.; U.S. Pat. No. 4,637,859 issued Jan. 20, 1987 to Trokhan; and U.S. Pat. No. 6,660,129 issued Dec. 9, 2003 to Cabell et al.

In the aforementioned belts of prior art the resinous framework is joined to the fluid-permeable reinforcing member (such as, for example, a woven structure, or a felt). The resinous framework may be continuous, semi-continuous, comprise a plurality of discrete protuberances, or any combination thereof. The resinous framework extends outwardly from the reinforcing member to form a web-side of the belt (i. e., the surface upon which the paper web is disposed during a papermaking process), a backside opposite to the web-side, and deflection conduits extending therebetween. The deflection conduits provide spaces into which papermaking fibers deflect under application of a pressure differential during a papermaking process. The terms "papermaking belt," and "forming member," may be used herein interchangeably.

Paper produced on the papermaking belts disclosed in the aforementioned patents are generally characterized by having at least two physically distinct regions: a region having a first elevation and typically having a relatively high density, and a region extending from the first region to a second elevation and typically having a relatively low density. This is because papermaking belts on which the paper is produced generally have two distinct regions at two distinct elevations, a first region at a first elevation associated with the resinous framework, and a second region at a second elevation associated with the woven (or felt) reinforcing member. The first region is typically formed from the fibers that have not been deflected into the deflection conduits, and the second region is typically formed from the fibers deflected into the deflection conduits of the papermaking belt. The papers made using the belts having a continuous resinous framework and a plurality of discrete deflection conduits dispersed therethrough comprise a continuous high-density network region and a plurality of discrete low-density pillows (or domes), dispersed throughout, separated by, and extending from the network region. The continuous high-density network region is designed primarily to provide strength, while the plurality of the low-density pillows is designed primarily to provide softness and absorbency. Such belts have been used to produce commercially successful products, such as, for example, BOUNTY® paper towels, CHARMIN® toilet tissue, and PUFFS® facial tissue, all produced and sold by The Procter & Gamble Co.

Certain aspects of absorbency of a fibrous structure, as well as its ability to clean more effectively, are highly dependent on its three-dimensional surface area. By three-dimensional surface area is meant the surface area that includes out-of-plane three-dimensionality such that a sheet of fibrous structure of a given overall two-dimensional size has a three-dimensional surface area greater than its two-dimensional calculated area. Attempts have been made to increase the three-dimensional surface area by increasing the number and placement of different elevations of a papermaking belt. That is, for a given fibrous web, the greater the web's three-dimensional surface area the higher the web's absorbency and cleaning performance. In the three-dimensional structured webs made on the aforementioned papermaking belts, the low-density pillows and the transition areas between the pillows and the relatively high density regions, dispersed throughout the web, increase the web's three-dimensional surface area, thereby increasing the web's absorbency. However, increasing the web's surface area by increasing the area comprising the relatively low-density pillows would result in decreasing the web's area comprising the relatively high-density network area that imparts the strength.

Attempts to increase absorbency and cleaning performance of absorbent paper products by increasing the three-dimensional surface area include using two layers of a resinous framework of the forming member. One example of using two layers of a resinous framework is shown in U.S. Pat. No. 6,660,129 B1, issued Dec. 9, 2003 to Cabell et al. Cabell et al. discloses a fibrous structure having at least a first region defining a first plane and having a first elevation, and a second region outwardly extending from the first plane to define a second elevation, wherein the second region comprises a plurality of fibrous pillows. Due to the nature of the resinous framework on the forming member described in Cabell et al., one feature of a fibrous structure made thereon is fibrous cantilever portions laterally extending at a second elevation. This is believed to be because of the nature of the process of producing the resinous framework of Cabell et al., which includes randomly dispersed cantilevered portions of the second layer of the resinous framework of Cabell et al. It is believed that the cantilevered portions can be weakened and fail during prolonged use of the belt, and, as well, fail to produce increased surface area in the finished paper of a type not requiring the cantilevered portions.

There is a continuing unaddressed need for a papermaking belt that can produce fibrous structures having greater absorbency and cleaning performance, particularly cleaning of soils and other solids, due to increased three-dimensional surface area.

Additionally, there is a continuing unaddressed need for a papermaking belt that can produce fibrous structures having distinct three-dimensional features in discrete planes, but which are not cantilevered.

Additionally, there is a continuing unaddressed need for a method for making a papermaking belt having a multi-stage, three-dimensional structure in a single pass.

Further, there is an unaddressed need for a three-dimensional mask that can produce a papermaking belt that can produce fibrous structures having distinct three-dimensional features in discrete planes, but which are not cantilevered.

SUMMARY OF THE INVENTION

A textured mask comprising a film is disclosed. The film can have a first substantially continuously flat surface lying in a first plane and a second surface opposite the first surface lying in a second plane substantially parallel to the first plane. The second surface is interrupted by a plurality of cavities, each of the cavities having a first depth defined by a third surface lying in a third plane substantially parallel to the first and second planes. The depth of the cavities can be at a distance of from about 0.1 mm to about 5 mm from the second plane. The textured mask is at least partially coated with an opaque masking agent. The textured mask can make a correspondingly structured three-dimensional papermaking belt, which can make correspondingly structured three-dimensional fibrous structure.

DETAILED DESCRIPTION OF THE INVENTION

Papermaking Belt

Figure 1:
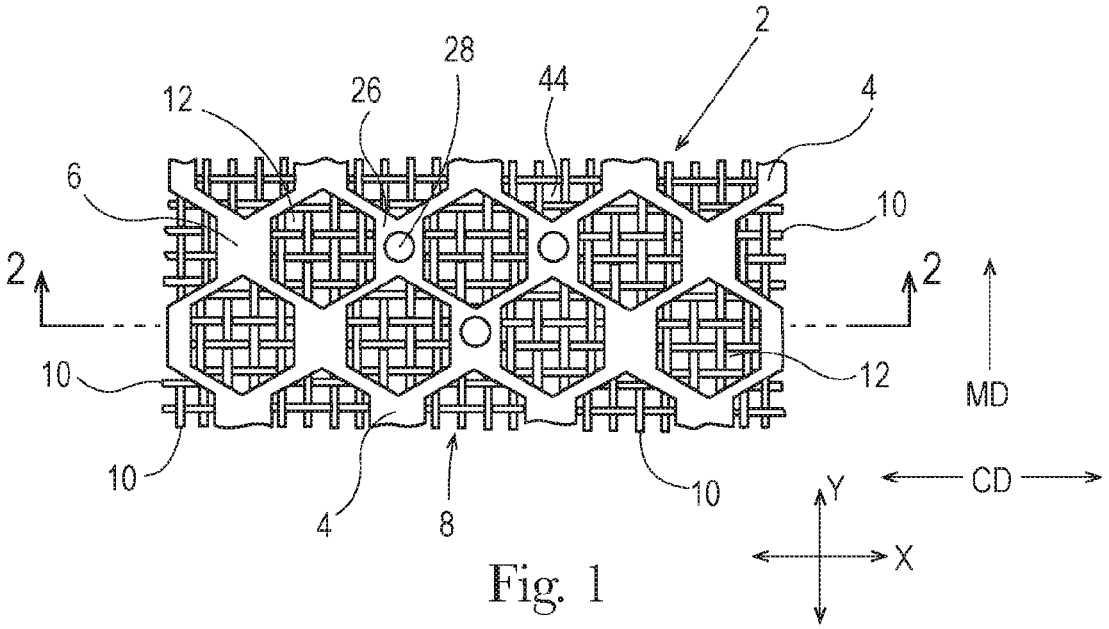
FIG. 1 is a plan view of a portion of a papermaking belt of the present invention made by a mask of the present invention.

In FIGS. 1-8, various embodiments of a papermaking belt 2 of the present invention are shown. In general, a papermaking belt 2 comprises a macroscopic, multi-elevational patterned framework, or, simply a "framework," of cured resin elements 4 commonly referred to as knuckles 6. The papermaking belt 2 can be utilized in a wet laid papermaking process which is typically used for making absorbent fibrous structures, including paper towels and bath tissue. The papermaking belt 2 can be adapted to any of the various forming wires and papermaking belts utilized by papermakers and can be designed to leave a physical, three-dimensional impression in the finished paper. Such three-dimensional impressions are well known in the art, particularly in the art of "through air drying" (TAD) processes, with such impressions often being referred to a "knuckles" and "pillows." Knuckles in a fibrous structure are typically relatively high density and/or three-dimensionally deformed regions formed by the corresponding knuckles 6 of a papermaking belt 2, i.e., the filaments or resinous structures that are raised at a higher elevation than other portions of the belt and are therefore pressed into the paper or permit fiber mobility during the papermaking process to achieve densified and/or three-dimensionally deformed regions. Likewise, "pillows" are typically relatively low density regions formed in the finished fibrous structure at the relatively uncompressed regions between or around knuckles 6. Further, the pillows in a fibrous structure can exhibit a range of densities relative to one another. The present invention is an improvement in the art in the making of knuckles 6 on papermaking belt 2 used as a papermaking belt. The improved papermaking belt is enabled by a mask of the present invention, and can make paper of the present invention.

Patterns of knuckles and pillows can be made generally according to the methods and processes described in U.S. Pat. No. 6,610,173, issued to Lindsay et al. on Aug. 26, 2003, or U.S. Pat. No. 4,514,345 issued to Trokhan on Apr. 30, 1985, together with the improved techniques disclosed herein. The Lindsay and Trokhan disclosures describe belts that are representative of papermaking belts made with cured resin on a woven reinforcing member, of which the present invention is an improvement. But further, the present improvement can make papermaking belts useful as a fabric crepe belt as disclosed in U.S. Pat. No. 7,494,563, issued to Edwards et al. on Feb. 24, 2009 or U.S. Pat. No. 8,152,958, issued to Super et al. on Apr. 10, 2012, as well as belt crepe belts, as described in U.S. Pat. No. 8,293,072, issued to Super et al on Oct. 23, 2012. When utilized as a fabric crepe belt, a papermaking belt of the present invention can provide the relatively large recessed pockets and three-dimensional knuckle dimensions to redistribute the fiber to a greater degree upon high impact creping in a creping nip between a backing roll and the fabric to form additional bulk in conventional wet press processes. Likewise, when utilized as a belt in a belt crepe method, a papermaking belt of the present invention can provide three-dimensional fiber enriched dome regions arranged in a repeating pattern corresponding to the pattern of the papermaking belt, as well as the interconnected plurality of surround areas to form additional bulk and local basis weight distribution in a conventional wet press process.

Figure 3:
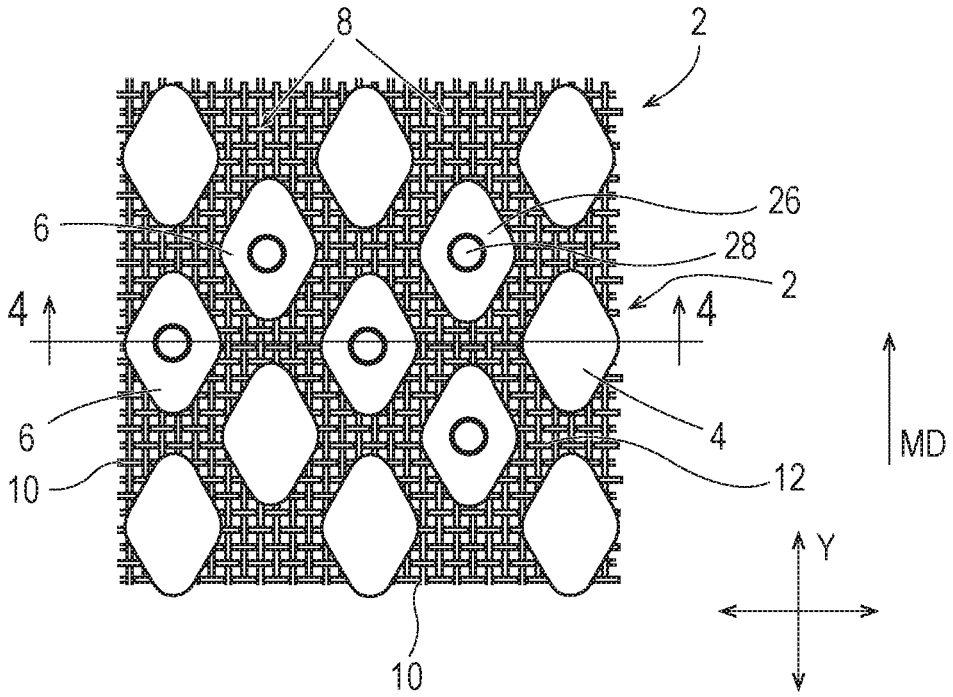
FIG. 3 is a plan view of a portion of a papermaking belt of the present invention made by a mask of the present invention.

Examples of papermaking belts 2 of the present invention are shown in FIGS. 1 and 3. As shown, a papermaking belt 2 can include cured resin elements 4 forming protuberances, also known as knuckles 6, and deflection conduits, known as pillows or pillow region 12, on a woven reinforcing member 8. The reinforcing member 8 can made of woven filaments 10 as is known in the art of papermaking belts, including resin coated papermaking belts. The knuckles 6 may be continuous, as shown in FIG. 1 in which case the pillows are discrete pillow regions 12. The papermaking belt structure shown in FIG. 3 includes discrete knuckles 6 and a continuous pillow region 12, also known in the art as a continuous deflection conduit. The knuckles 6 of the papermaking belt can form relatively high density knuckles in the fibrous structure made thereon in a pattern corresponding to the knuckles 6 of the papermaking belt. Likewise, the pillow regions 12 of the papermaking belt can form relatively low density pillows or pillow regions in the fibrous structure made thereon in a pattern corresponding to the pillow regions 12 of the papermaking belt.

The papermaking belt 2 may be made from a variety of materials, including but not limited to: resinous material, metal, metal-impregnated resin, plastic, polymers such as a polyurethane material, or any combination thereof that can form a patterned framework of knuckles. As used herein, the term "patterned framework" or "framework" does not include a structure that is formed solely by mutually perpendicular interwoven filaments, such as, for example, a forming wire or a similarly formed structure. Such a structure, comprising a plurality of mutually perpendicular filaments, may be used as a reinforcing member 8 in the papermaking belt 2 of the present invention, as will be discussed below, but does not constitute the framework of knuckles 6 of the papermaking belt 2.

If the papermaking belt 2 is made with a resinous material or other material having a pattern that can be distorted when pulled in a machine direction, a reinforcing member 8 is typically used to reinforce the framework of the papermaking belt 2. The reinforcing member 8 may be necessary when the patterned framework comprises a semi-continuous pattern or a pattern comprising a plurality of discrete protuberances, as shown in FIG. 3. The reinforcing member 8 is positioned between the web-side 14 and at least a portion of the backside 16 of the papermaking belt 2. While the reinforcing member 8 is generally parallel to the backside 16 of the papermaking belt 2, a portion of the reinforcing member 8 may extend beyond the backside 16 of the papermaking belt 2, thereby creating surface irregularities in the backside 16 of the papermaking belt 2. In some embodiments, the reinforcing member 8 may comprise the backside 16 of the papermaking belt 2.

The papermaking belt 2 can be joined to the reinforcing member 8. The reinforcing member 8 has an upper side 18 and a lower side 20 opposite to the upper side 18. The web-side 14 of the papermaking belt 2 and the upper side 18 of the reinforcing member 8 face one direction, and the backside 16 of the papermaking belt 2 and the lower side 20 of the reinforcing member 8 face the opposite direction. As defined herein, the backside 16 of the papermaking belt 2 forms an X-Y plane. Since the reinforcing member 8 is typically near or adjacent to the backside 16 of the papermaking belt 2 (e.g., FIGS. 2, 4), it could also be said that in some embodiments the reinforcing member 8, as a whole, defines the X-Y plane. One skilled in the art will appreciate that the symbols "X," "Y," and "Z" designate a system of Cartesian coordinates, wherein mutually perpendicular "X" and "Y" define a reference plane formed by the backside 16 of the papermaking belt 2 (or by the reinforcing member 8) when the papermaking belt 2 is disposed on a flat surface, and "Z" designates any direction perpendicular to the X-Y plane. Analogously, the term "Z-dimension" means a dimension, distance, or parameter measured parallel to the Z-direction. It should be carefully noted, however, that an element that "extends" in the Z-direction does not need itself to be oriented strictly parallel to the Z-direction; the term "extends in the Z-direction" in this context merely indicates that the element extends in a direction which is not parallel to the X-Y plane. Analogously, an element that "extends in a direction parallel to the X-Y plane" does not need, as a whole, to be parallel to the X-Y plane; such an element can be oriented in the direction that is not parallel to the Z-direction.

Figure 17:
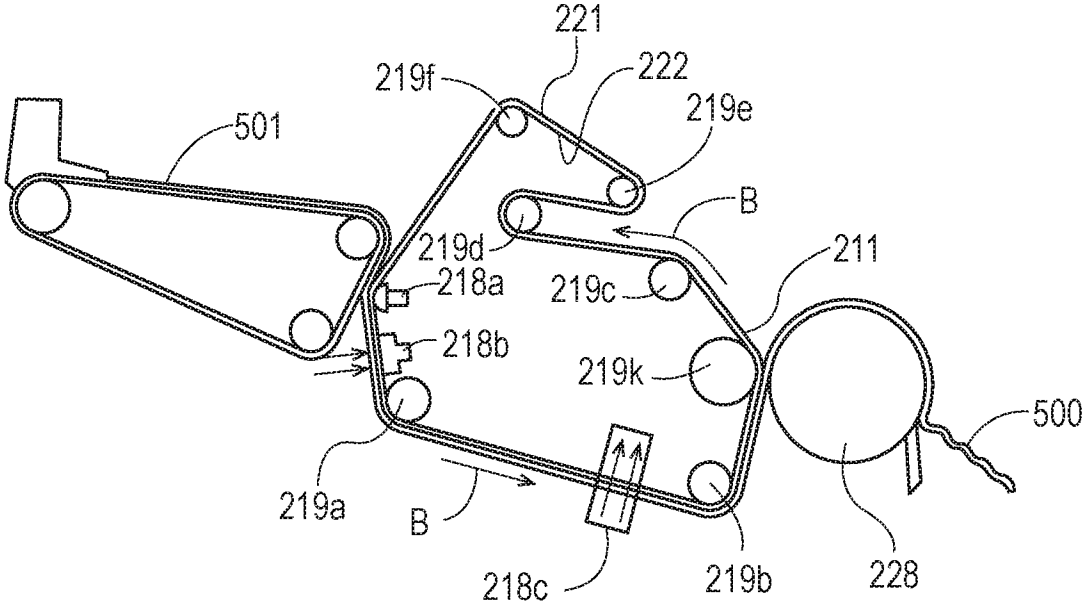
FIG. 17 is a schematic elevation view of an apparatus for making a fibrous structure of the present invention.
Figure 18:
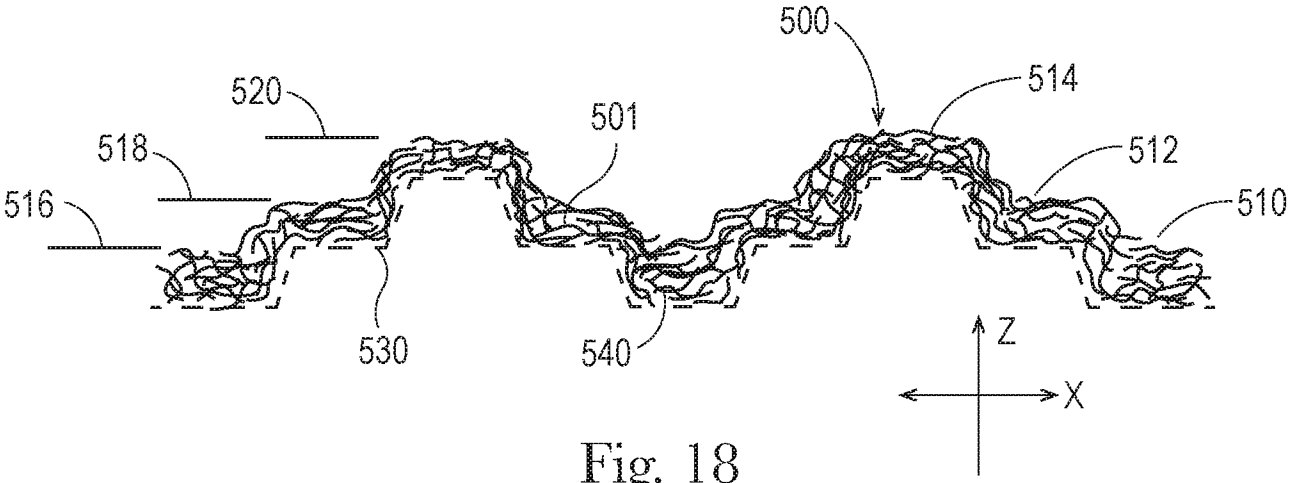
FIG. 18 is a representative view in elevation of a portion of a fibrous structure that can be made on a papermaking belt of the present invention.

One skilled in the art will also appreciate that the reinforcing member 8, as well as the papermaking belt 2 as a whole, does not need to (and indeed cannot in some embodiments) have a planar configuration throughout its length, especially when used in a typical industrial process for making a fibrous structure 500 of the present invention, as shown in FIG. 18. A papermaking belt 2 in the form of an endless belt travels through the equipment in a direction indicated by a directional arrow "B" (FIG. 17). Therefore, the concept of the papermaking belt 2 being disposed on a flat surface and having the "X-Y" plane is conventionally used herein for the purpose of describing relative geometry of several elements of the generally flexible papermaking belt 2. A person skilled in the art will appreciate that when the papermaking belt 2 curves, the X-Y plane follows the configuration of the papermaking belt 2.

In some embodiments, the reinforcing member 8 is substantially fluid-permeable. The fluid-permeable reinforcing member 8 may comprise a woven screen, or an apertured element, a felt, a film, or any combination thereof. Various types of the fluid-permeable reinforcing member 8 are described in several commonly assigned U.S. Patents, for example, U.S. Pat. Nos. 5,275,700 and 5,954,097. The reinforcing member 8 may comprise a felt, also referred to as a "press felt" as is used in conventional papermaking. The framework may be applied to the reinforcing member 8, as taught by commonly assigned U.S. Pat. No. 5,549,790, issued Aug. 27, 1996 to Phan; U.S. Pat. No. 5,556,509, issued Sep. 17, 1996 to Trokhan et al.; U.S. Pat. No. 5,580,423, issued Dec. 3, 1996 to Ampulski et al.; U.S. Pat. No. 5,609,725, issued Mar. 11, 1997 to Phan; U.S. Pat. No. 5,629,052 issued May 13, 1997 to Trokhan et al.; U.S. Pat. No. 5,637,194, issued Jun. 10, 1997 to Ampulski et al.; U.S. Pat. No. 5,674,663, issued Oct. 7, 1997 to McFarland et al.; U.S. Pat. No. 5,693,187 issued Dec. 2, 1997 to Ampulski et al.; U.S. Pat. No. 5,709,775 issued Jan. 20, 1998 to Trokhan et al., U.S. Pat. No. 5,795,440 issued Aug. 18, 1998 to Ampulski et al., U.S. Pat. No. 5,814,190 issued Sep. 29, 1998 to Phan; U.S. Pat. No. 5,817,377 issued Oct. 6, 1998 to Trokhan et al.; and U.S. Pat. No. 5,846,379 issued Dec. 8, 1998 to Ampulski et al.

Alternatively, in some embodiments, the reinforcing member 8 may be fluid-impermeable. The fluid-impermeable reinforcing member 8 can comprise, for example, a polymeric resinous material, identical to, or different from, the material used for making a papermaking belt 2 of the present invention; a plastic material; a metal; a film, or any other suitable natural or synthetic material; or any combination thereof. One skilled in the art will appreciate that the fluid-impermeable reinforcing member 8 will cause the papermaking belt 2, as a whole, to be also fluid-impermeable.

If desired, the reinforcing member 8 comprising a Jacquard weave can be utilized. Illustrative belts having the Jacquard weave can be found in U.S. Pat. No. 5,429,686 issued Jul. 4, 1995 to Chiu, et al.; U.S. Pat. No. 5,672,248 issued Sep. 30, 1997 to Wendt, et al.; U.S. Pat. No. 5,746,887 issued May 5, 1998 to Wendt, et al.; and U.S. Pat. No. 6,017,417 issued Jan. 25, 2000 to Wendt, et al. It is believed that a Yankeeless process may benefit from using the papermaking belt 2 of the present invention by providing additional three-dimensionality to a fibrous structure during the web formation process.

It is to be understood that the present invention contemplates a papermaking belt 2 previously unachievable with prior techniques. Specifically, in general, the multi-elevational framework of knuckles of the invention comprises a plurality of Z-direction spatially separated surfaces defined in order spatially with respect to the backside 16 of the papermaking belt 2. Each surface can be substantially parallel to the X-Y plane. Further, each successive surface progressing in a Z-direction away from the backside 16 toward a web side 14 has a projected area less than the projected area of the surface adjacent and closer to the backside 16, and is bounded completely by the area of the projected area of the surface adjacent and closer to the backside 16. The concept of projected area and description of the framework of the invention as well as a mask to make the framework and fibrous structures made on the framework is described more fully below.

Figure 2:
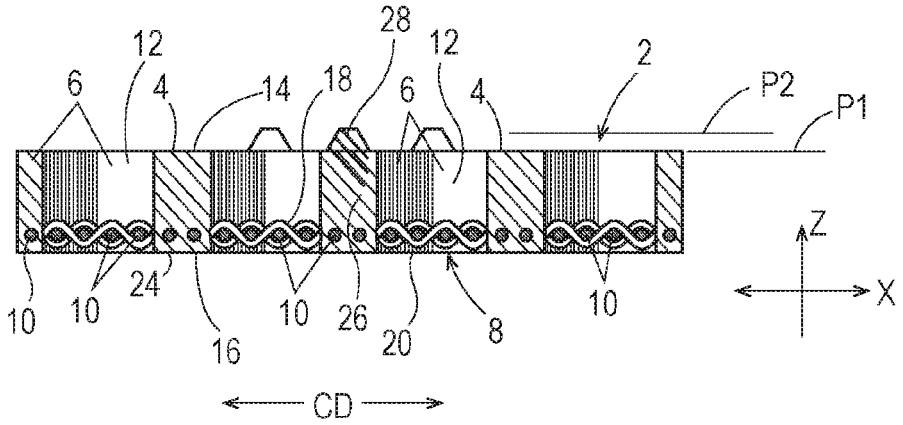
FIG. 2 is a cross-sectional view of the papermaking belt shown in FIG. 1, taken along lines 2-2 of FIG. 1.
Figure 4:
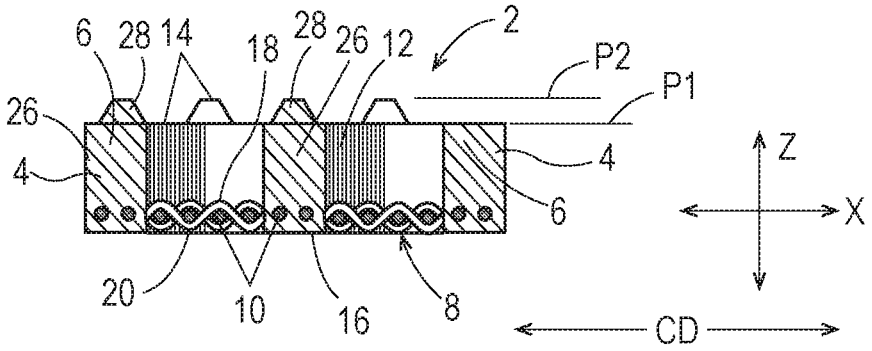
FIG. 4 is a cross-sectional view of the papermaking belt shown in FIG. 3, taken along lines 4-4 of FIG. 3.

As shown in FIGS. 1 and 3, and with respect to FIGS. 2 and 4, respectively, knuckles 6 have at least, but not limited to, two portions, a base portion 26 and an extended portion 28. As shown in more detail in FIG. 5, the base portion 26 can define a first surface 30 in a first plane P1, and the extended portion 28 can define a second surface 32 in a second plane P2, with the second plane P2 being spaced a greater distance in the Z-direction from backside 16 than the first plane P1. As shown, the base portion 26 can be a continuous knuckle portion (as shown in FIG. 1) or discontinuous knuckle portion of discrete knuckles (as shown in FIG. 3). Likewise, in an embodiment of a continuous base portion 26, the extended portion 28 can be correspondingly continuous or discontinuous or semi-continuous. Although FIGS. 1 and 3 depict a base portion and an extended portion 28 defining only one second surface 32, it is contemplated that additional extended portions can be incorporated, such as a plurality of extended portions each having a surface in a subsequent plane PS, to form additional extended portions extending from extended portion 28, in "wedding cake" style of progressively smaller extended portions, each having a projected area bounded by the projected area of the previous portion. In an embodiment, the distance in the Z-direction between surfaces can be from about 0.1 mm to about 1.0 mm, or greater, up to about 5 mm. In an embodiment, therefore, the distance in the first surface 30 to second surface 32 shown in FIG. 5 can be from about 0.1 mm to about 1.0 mm or greater, up to about 5 mm.

Figure 5:
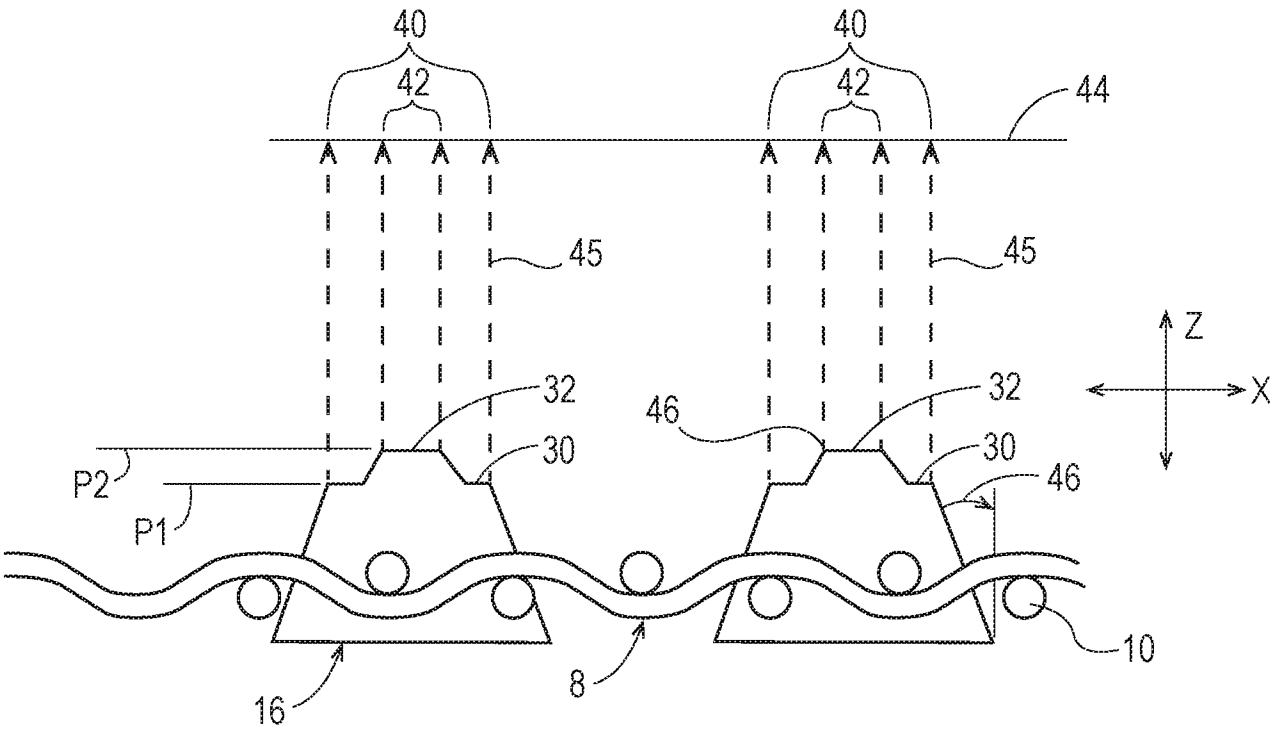
FIG. 5 is a schematic representation of a portion of the cross-sectional view of FIGS. 2 and 4.
Figure 6:
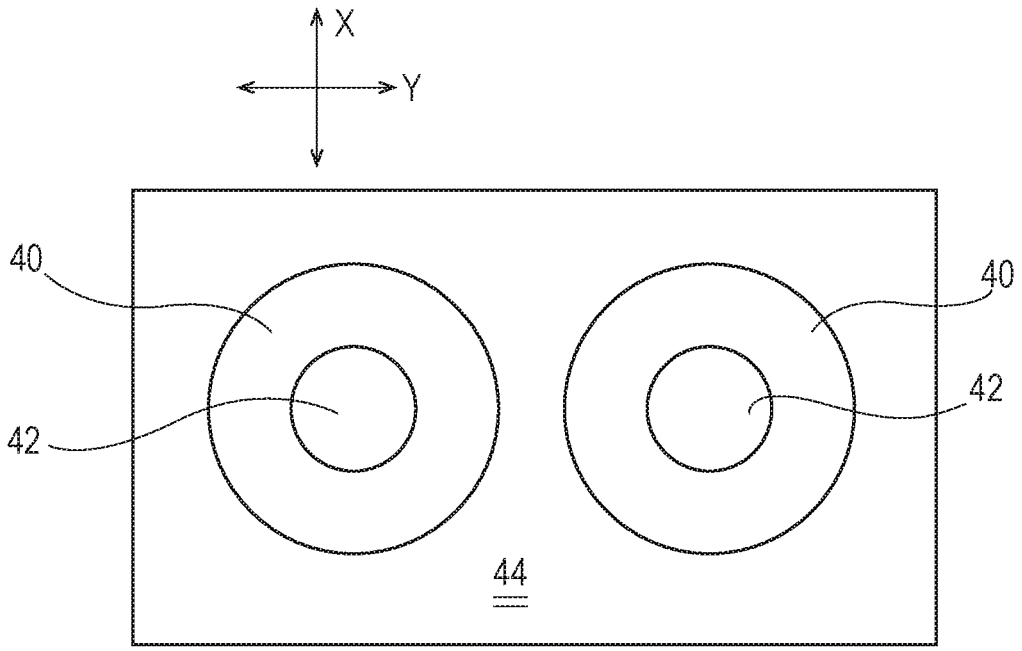
FIG. 6 is a schematic plan view of representative area representations of papermaking belt of the present invention.

By "projected area" is meant an area of a surface as it would be projected in the Z-direction onto an X-Y plane, 44, as shown in FIGS. 5 and 6, and as indicated by arrows 45 in FIG. 5. As shown, the framework of knuckles 6 can be described as having a plurality of multi-stage surfaces. In FIG. 5 two surfaces are shown, a first surface 30 residing in a first plane P1 and a second surface 32 residing in a second plane P2. While two surfaces are described, the invention is not limited to only two surfaces. For each surface, the area of the surface can be determined by projecting in a Z-direction as indicated by arrows 45 the surface area of the surface to an X-Y plane, 44. As shown in FIGS. 5 and 6, for example, the area of first surface 30 can be projected to be Area 1, 40 in the X-Y plane, and the area of second surface 32 can be projected to be Area 2, 42 in the X-Y plane. As can be appreciated from the description herein, Area 2, 42, is smaller than, and fully bounded by Area 1, 40. That is, no part of the portion of the second surface 32 of the framework 20 extends over or beyond the area of first surface 30 in the X-Y plane, as would be the case if any part of the extended portion 28 was cantilevered over base portion 26. Correspondingly, the structure of the framework of knuckles 6 that forms second surface 32 is smaller than, and fully "bounded," so to speak, in the X-Y dimension, by the structure of the framework that forms the first surface 30.

"Draft angles" 46 of sidewalls the Z-direction-oriented three-dimensional features may be present in the structure of the knuckles 6 of the papermaking belt 2, as shown in FIG. 5. Therefore, with respect to a measure of projected areas, the area is projected from the surface in the plane of the surface, as shown in FIG. 5. This technique eliminates any ambiguity introduced by sloping sides of the portions of the structures defining the respective surfaces, and substantially corresponds in size and shape to the transparent portions of a mask used to make the papermaking belt, as disclosed below. By using projected area as the area dimension, any complexities introduced by draft angles or non-planar surfaces 30, 32 can be eliminated. For example, if second surface 32 as shown in FIG. 5 were slightly dome shaped or had some irregular surface features, the area for purposes of the present invention can be determined using the projected area. However, for purposes of the present invention, the actual numerical value of any projected area is not critical to be determined. The invention is achieved if each successive feature of the knuckle portion has a qualitatively determined smaller projected area than the one before it, again, in "wedding cake" style.

Figure 7:
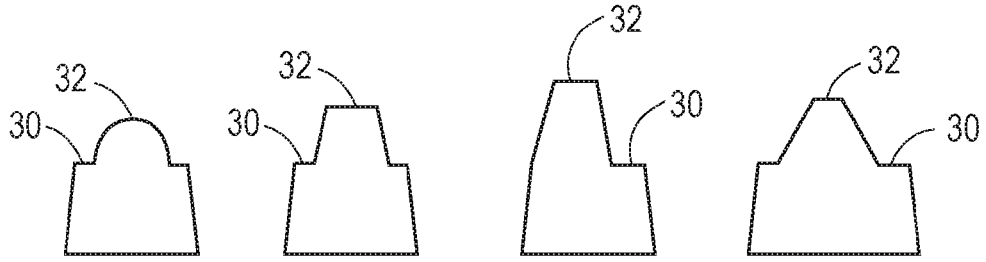
FIG. 7 is a schematic cross-sectional representation of various knuckle configurations of a papermaking belt of the present invention.
Figure 8:
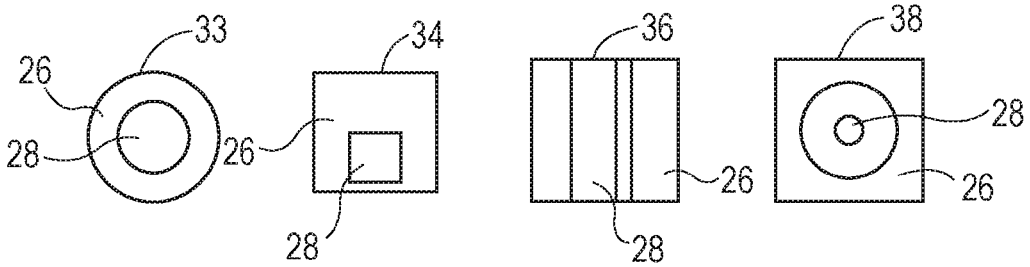
FIG. 8 is a schematic plan view of the representative knuckle configurations shown in FIG. 7.

In an embodiment, the extended portion 28 can be designed to have a shape and predetermined position with respect to the base portion 26, such as being fully centrally registered with respect to the base portion 26 in the X-Y dimension, but in any configuration the extended portion 28 does not extend beyond the boundaries of the projected area of the base portion 26 to form a cantilevered, or overhanging, member. Any other configuration is contemplated, however, and several various embodiments of example configurations of base portions 26 and extended portions 28 are shown schematically in FIGS. 7 and 8. FIG. 7 shows non-limiting representative knuckle shapes in elevation. Note that the knuckles shown in FIG. 7 can be representative of either a continuous knuckle papermaking belt as shown in FIG. 1, or a discrete knuckle papermaking belt as shown in FIG. 3. FIG. 8 shows exemplary plan views of the knuckles shown in FIG. 7. The knuckles shown in plan view in FIG. 8 are represented as discrete knuckles, but the general geometry can easily be extended to continuous knuckles, or semi-continuous. As shown in FIG. 8 at 33, extended portion 28 can be substantially centrally positioned on base portion 26. While 33 shows a generally circular shaped base portions 26 and extended portion 28, the shape of either portion can be virtually any shape desired, limited only by the mask making process, described below. At 34, extended portion 28 is offset from center on base portion 26. While 34 shows a generally square shaped base portions 26 and extended portion 28, the shape of either portion can be virtually any shape desired. At 36, extended portion 28 is offset from center on base portion 26 and generally ridge-like. While 36 shows a generally square shaped base portions 26 and ridge-like extended portion 28, the shape of either portion can be any shape desired. At 38, extended portion 28 is generally conically shaped. While 38 shows a generally circular shaped base portions 26 and generally circular shaped extended portion 28, the shape of either portion can be virtually any shape desired.

Figure 9:
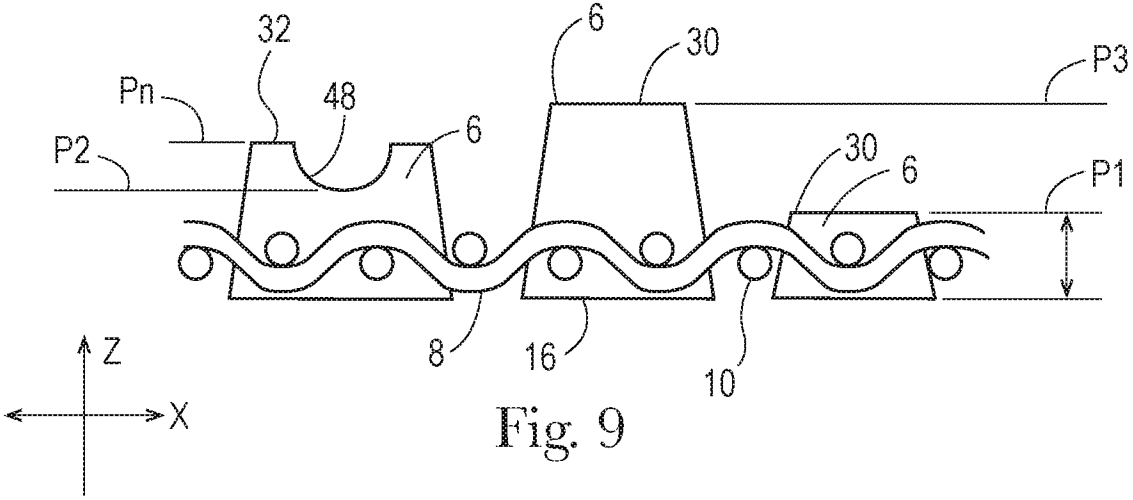
FIG. 9 is a schematic elevation view of representative alternative configurations of patterns of knuckles on a papermaking belt of the present invention.

In general, as shown in FIG. 9, the knuckles 6, such as discrete knuckles 6 shown in FIG. 3, need not all be substantially identical in shape or size. For example, in an embodiment, one knuckle 6 can have a first surface 30 at a Z-direction dimension $D_Z$ defining a first plane P1, and another knuckle can have a first surface 30 at a different Z-direction dimension $D_Z$ defining a second plane P2. Further, in general, the uppermost surface, such as second surface 32 described above at a plane Pn, can have indentations, or a third surface 48, having a portion at a plane P2 in between a first plane P1 and second plane P3.

Process for Making Papermaking Belt

Figure 10:
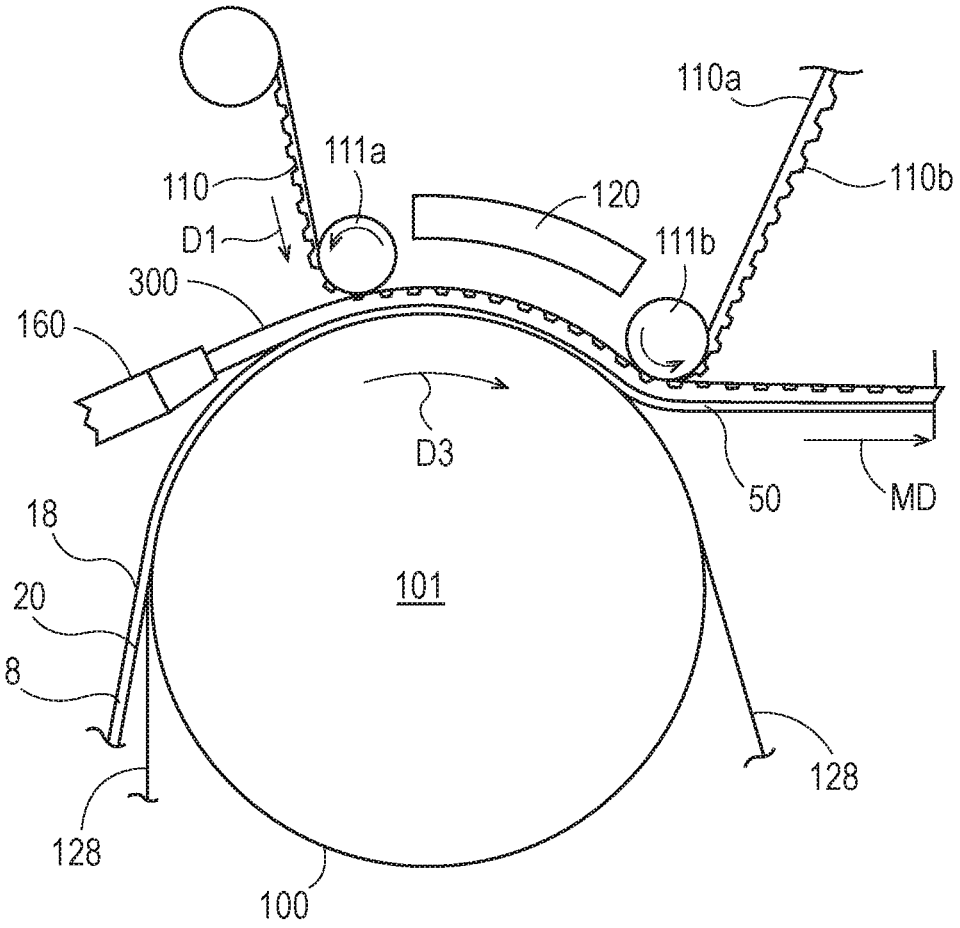
FIG. 10 is a schematic representation of an apparatus and method for making a belt of the present invention.

A process for making the papermaking belt 2, according to one embodiment of the present invention, is shown in FIG. 10. Specifically, the process produces a multi-elevational papermaking belt 2, and does so in a single pass through the apparatus described herein with respect to FIG. 10. The papermaking belt 2 can be formed using a forming surface 100. As used herein, the term "forming surface" means a surface of a forming unit structured and configured to support a coating of a suitable curable material, such as, for example, a liquid photosensitive resin. The curable material can be deposited directly to the forming surface, or it can be deposited to a backing film provided to cover the forming surface to avoid contamination thereof by the liquid curable material. In the embodiment shown in FIG. 10, a curable material 300, comprising, for example, a liquid photosensitive resin, is deposited to the forming surface 100 covered by a backing film 128. The forming surface 100 is formed by a forming unit comprising a drum 101.

If desired, the forming surface may comprise a deformable surface, as described in the commonly assigned U.S. Pat. No. 5,275,700. When the reinforcing member 8 is pressed into the deformable forming surface during the process of making, the deformable forming surface forms protrusions that exclude the curable material from certain areas which, when cured, will lie along the backside 16 of the papermaking belt 2. This causes the reinforcing member to extend at least partially beyond the back side of the framework of the papermaking belt 2 to form a so-called "textured" backside 16 having passageways providing texture irregularities therein. Those texture irregularities are beneficial in some embodiments of the papermaking belt 2, because they prevent formation of a vacuum seal between the backside of the papermaking belt 2 and a surface of the papermaking equipment (such as, for example, a surface of a vacuum box or a surface of a pick-up shoe), thereby creating a "leakage" there between and thus mitigating undesirable consequences of an application of a vacuum pressure in a through-air-drying process of making a fibrous structure 500 of the present invention. Other methods of creating such a leakage are disclosed in commonly assigned U.S. Pat. Nos. 5,718,806; 5,741,402; 5,744,007; 5,776,311; and 5,885,421.

The leakage can also be created using so-called "differential light transmission techniques" as described in commonly assigned U.S. Pat. Nos. 5,624,790; 5,554,467; 5,529,664; 5,514,523; and 5,334,289. The papermaking belt is made by applying a coating of photosensitive resin to a reinforcing member that has opaque portions, and then exposing the coating to light of an activating wavelength through a mask having transparent and opaque regions, and also through the reinforcing member 8.

Another way of creating backside surface irregularities comprises the use of a textured forming surface, or a textured barrier film, as described in commonly assigned U.S. Pat. Nos. 5,364,504; 5,260,171; and 5,098,522. The papermaking belt 2 is made by casting a photosensitive resin over and through the reinforcing member while the reinforcing member travels over a textured surface, and then exposing the coating to light of an activating wavelength through a mask which has transparent and opaque regions.

As shown in FIG. 10, a backing film 128 is provided to protect the forming surface 100 and to facilitate removal of the partially completed forming structure from the forming surface 100. In a continuous process of FIG. 10, the backing film 128 is traveling in a direction indicated by directional arrows D3, which is the direction of rotation of drum 101. As an example, in the embodiment of FIG. 10, the backing film 128 is a single-use film, which can be supplied by a supply roll and wound into a take-up roll (not shown) and is typically discarded after the use.

In the embodiment shown in FIG. 10, the process of forming the papermaking belt 2 comprises the following steps. If the papermaking belt 2 is to have a reinforcing member, then a reinforcing member 8 is provided. The reinforcing member 8 is supported by the first forming surface 100 such that the lower side 20 of the reinforcing member 8 faces the forming surface 100 and can be in contact therewith or with the first backing film 128 if such backing film is used, as explained above. Typically, but not necessarily, the reinforcing member 8 is placed in direct contact with the backing film 128. In the continuous process illustrated in FIG. 10, the reinforcing member 8 can be supplied from a supply roll (not shown). It is also contemplated in the present invention that the reinforcing member 8 may be supplied in the form of an endless belt, as described, for example, in commonly assigned U.S. Pat. No. 4,514,345. In FIG. 10, the reinforcing member 8 is traveling in a machine direction MD.

The use herein of the term "machine direction" is consistent with the traditional use of the term in papermaking, where this term refers to a direction which is parallel to the flow of the paper web through the papermaking equipment. In the context of the continuous process of making the papermaking belt 2, the "machine direction" is a direction parallel to the flow of the coating of the curable material (or the reinforcing member where applicable) during the process of the present invention. It should be understood that the machine direction is a relative term defined in relation to the movement of the coating at a particular point of the process. Therefore, the machine direction may (and typically does) change several times during a given process of the present invention. A term "cross-machine direction" is a direction perpendicular to the machine direction and parallel to the general plane of the papermaking belt 2 being constructed, or the X-Y plane.

A coating of curable material 300, such as, for example, a liquid photosensitive resinous material, is applied to the reinforcing member 8, and specifically, to its upper side 18. Any technique by which the liquid curable material can be applied to the reinforcing member 8 is suitable. For example, a nozzle 160, schematically shown in FIG. 10, can be used. Typically, the curable material 300 should be evenly applied throughout a width of the reinforcing member 8 or a portion thereof. The width of the reinforcing member 8 and a width of the forming surface 100 extend in the cross-machine direction. If the reinforcing member 8 has voids designed and structured to be penetrated by the curable material 300, such as, for example, the reinforcing member comprising a plurality of interwoven yarns, the curable material should be applied such that a sufficient amount of the curable material can be worked through the first reinforcing member 8 to achieve a secure joining therebetween.

Suitable curable materials that can be readily selected from the many those commercially available. For example, the curable material may comprise liquid photosensitive resins, such as polymers that can be cured or cross-linked under the influence of a suitable radiation, typically an ultraviolet (UV) light. References containing more information about liquid photosensitive resins include Green et al., "Photocross-linkable Resin Systems," J. Macro-Sci. Revs. Macro Chem., C21 (2), 187-273 (1981-82); Bayer, "A Review of Ultraviolet Curing Technology," Tappi Paper Synthetics Conf. Proc., Sep. 25-27, 1978, pp. 167-172; and Schmidle, "Ultraviolet Curable Flexible Coatings," J. of Coated Fabrics, 8, 10-20 (July, 1978). All the preceding three references are incorporated herein by reference.

The next step is optional and comprises controlling a thickness of the coating to a pre-selected value. In some embodiments, this pre-selected value is dictated by a desired thickness of resin layer and will influence the resulting thickness of the papermaking belt 2. This resulting thickness of the papermaking belt 2 is primarily dictated by the expected use of the papermaking belt 2. For example, when the papermaking belt 2 is to be used in a process for making a fibrous structure, described hereinafter, the papermaking belt 2 is typically from about 0.3 mm to about 10.0 millimeters thick. Any suitable means for controlling the thickness of the layer 300 can be used in the process. For example, illustrated in FIG. 10 is the use of a roll 111*a*. A clearance between the roll 111*a* and the forming surface 100, or more specifically between the roll 111*a* and the backing film 128, can be controlled manually or mechanically, by any conventional means (not shown).

The coating is then cured via UV light radiation through the mask. The intensity of the radiation and its duration depend upon the degree of curing required in the areas exposed to the radiation. In the instance of the photosensitive resin, the absolute values of the exposure intensity and time depend upon the chemical nature of the resin, its photo characteristics, the pattern selected, and the thickness of the coating, or of the desired depth of its areas, to be cured. Further, the intensity of the exposure and the angle of incidence of the curing radiation can have an important effect on the presence or absence of taper in the walls of the pre-selected pattern of the framework to be constructed. The disclosure of commonly assigned U.S. Pat. No. 5,962,860, issued Oct. 5, 1999 in the name of Trokhan et al. for teaching an apparatus for generating controlled radiation for curing a photosensitive resin, comprising a reflector having a plurality of elongate reflective facets that are adjustable such as to direct the curing radiation substantially to a desired direction. The patent further discloses a radiation management device comprising a mini-reflector juxtaposed with the source of radiation for controlling the direction and intensity of the curing radiation.

The reinforcing member 8 comprising so-called "fugitive tie yarns" may be beneficially used for the second layer 40. Commonly assigned PCT application WO 1999/14425, published on Mar. 25, 1999, and titled Multiple Layer Foraminous Belts With Fugitive Tie Yarns, discloses a belt for supporting a cellulosic fibrous structure in a papermaking process and a method of producing the belt. The belt comprises a reinforcing member having two layers, a web-contacting first layer and a machine-facing second layer, and a pattern layer comprising a cured photosensitive resin, the pattern layer having a plurality of conduits therethrough. The two layers of the reinforcing member are joined together by either integral or adjunct tie yarns such that at least a portion of the tie yarns which lies within the conduits is removable after the photosensitive resin has been cured. These "fugitive" tie yarns are substantially transparent to actinic radiation and can be removed by chemical or mechanical processes when they are no longer needed to stabilize the relationship between the web-facing layer and the machine-facing layer of the reinforcing member. In particular, the portion of the fugitive tie yarns that lies within the conduits can be removed so that belt properties, such as projected open area, are substantially isotropic across the belt. A means to remove the fugitive adjunct tie yarns may include a combination of solubilization and mechanical energy provided by showering systems that are part of the belt-making and papermaking processes. Suitable materials for the fugitive tie yarns comprise those that can be controllably removed by chemical or mechanical means.

Mask

A mask 110 is positioned between the coating of the curable material 300 and a source of curing radiation 120. In the instance of a photosensitive resin, the source of curing radiation 120 may comprise, for example, a mercury arc lamp or an LED source. The mask 110, a portion of which is shown in perspective view in FIG. 11, comprises a relatively thin and flexible structure, typically in the nature of film, having a substantially continuously flat top side 110*a* and a bottom side 110*b* opposite to the top side 110*a*, the bottom side 110*b* being interrupted from a substantially continuously flat configuration by cavities 116. In this context "top" and "bottom" are used for convenience and relate to the in-use configuration shown in FIG. 10, in which "top" is up, and "bottom" is down. In general, however, the film has two major surfaces corresponding to the two sides of the relatively thin film mask, either of which could in practice be top or bottom. In practice the film can be a laminate.

Figure 11:
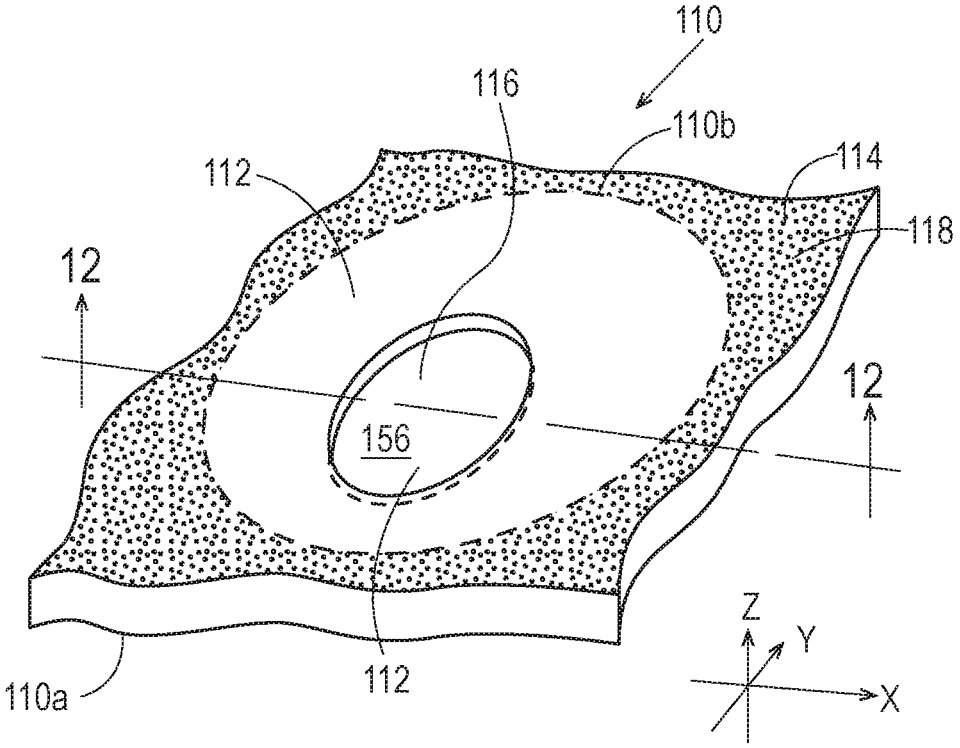
FIG. 11 is a perspective view of a portion of a mask of the present invention.

In the exemplary portion shown in FIG. 11, only one cavity 116 corresponding to one knuckle portion of the papermaking belt 2 is shown. In the exemplary embodiment of a portion of the mask, as shown in FIG. 11, for example, the cavity 116 has a three-dimensional structure that provides a third surface 156 at a depth DM1 (shown in FIG. 12), which enables the three dimensional structure of the corresponding knuckle formed by it, such as one of the discrete knuckles 6 shown in FIG. 3. However, the example described with respect to FIG. 11 is only exemplary, and is not to be limiting. For example, the third surface 156 (and fourth, fifth surfaces, etc.) need not be flat and in a plane substantially parallel to the first or second surfaces. In an embodiment where the third surface is not flat, average depth measure can be used for depth DM1. As described more fully below, the mask 110 comprises transparent regions 112 and opaque regions 114. As used herein, the term "opacity" and "opaque" mean lack of transparency or translucency in certain areas of the mask 110, and designates those areas' quality of being shaded such as to be impervious or partially impervious to the rays of curing radiation.

Figure 12:
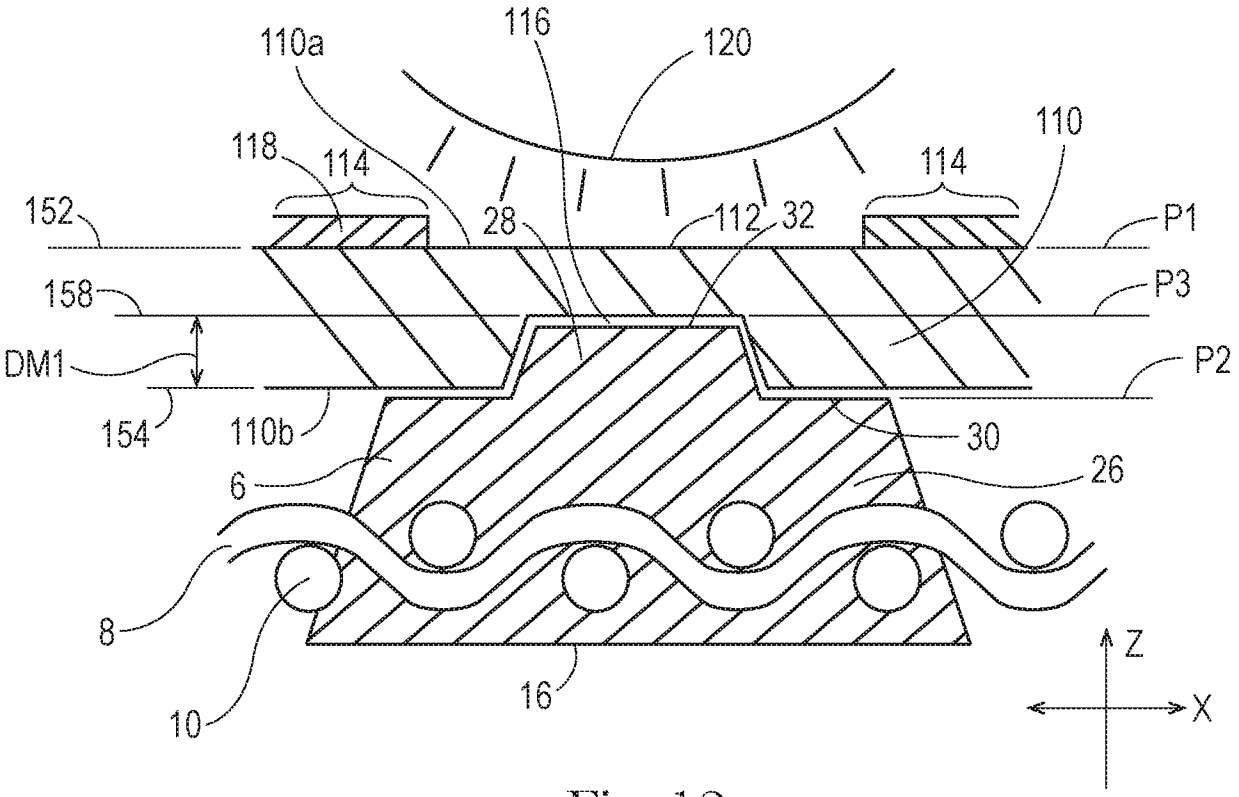
FIG. 12 is partially a schematic representation of a cross-section of the mask shown in FIG. 11 and taken along lines 12-12, and is a schematic elevation view of a portion of a mask of the present invention and a portion of a papermaking belt made with it.

The portion of mask 110 shown in FIG. 11 is shown in cross-section in FIG. 12, together with a representative knuckle 6 formed by radiant curing of a curable resin. As shown, the mask 110 has a topside 110*a* and a bottom side 110*b*, with the top and bottom being with respect to the typical orientation in use. In use, the bottom side 110*b* is in contact with the curable resin used to form the papermaking belt 2, allowing the curable resin to flow into cavity, which acts as a mold to form a knuckle which takes the shape of the cavity. As shown, cavity 116 is characterized by defined surfaces similar to the surfaces described with respect to knuckles 6 on the papermaking belt 2. Thus, broadly speaking, the topside 110*a* of the mask lies in a first mask plane 152, and the bottom side 110*b* lies in a second mask plane 154. Between the first mask plane 152 and second mask plane 154 can be a plurality of planes corresponding to surfaces in cavity 116. As can be understood, the surfaces in mask 110 correspond virtually identically to the surfaces, i.e., second surface 32, of knuckles 6. Therefore, the number of planes corresponding to surfaces in cavity 116 can be varied according to the desired pattern of knuckles, and the exemplary cavity 116 shown in FIG. 12 has one such mask plane, third mask plane 158, designated as P3 in FIG. 12. But the design of cavity 116 can be modified with other surfaces in mask planes (not shown) as desired for the desired knuckle configuration of papermaking belt 2, to form corresponding surfaces 32 of knuckles 6. The design shown in FIG. 12 corresponds generally to one capable of achieving a knuckle configuration on a papermaking belt 2 as shown in FIG. 5, as well as other patterns, depending, for example, on the opaque pattern applied to mask 110, as described more fully below.

With reference to FIG. 12, in an embodiment having a first mask plane 152 and a generally parallel third mask plane 158, the cavity can define a first step in cavity 116, and a second step plane (not shown), generally parallel to and spaced from first step plane 156 in a direction away from second mask plane 154. As discussed above with respect to the knuckles 6, each surface portion of cavity 116 defined by a distance progressively away from second mask plane 154 has a projected area less than the projected area of the next adjacent plane in the Z-direction, and is fully bounded by the area of the adjacent plane.

The purpose of the mask 110 is to shield certain areas of the curable material 300, i.e., those areas that are shielded by the opaque regions 114, from exposure to curing radiation and to form a three dimensional knuckle structure. The three-dimensional structure of the mask serves to mold a substantially identically shaped three-dimensional structure of a knuckle of a papermaking belt, which likewise serves to form the three-dimensional structure of a fibrous structure made on the papermaking belt. The novel three-dimensional structure of the fibrous structure so formed serves to increase the absorbency and cleaning performance of the fibrous structure by providing relatively more surface area in a given sheet of fibrous structure than was previously possible in prior structures.

One method for providing shielding is to apply an opaque coating, which can be an opaque ink, 118 to in a pattern to form transparent regions of the mask and opaque regions of the mask corresponding to the desired pattern of the resulting papermaking belt 2. The transparent regions 112 of the mask 110 allow other (unshielded or partially shielded) areas of the curable resin to be exposed to and receive the curing radiation which results in hardening, i. e., curing, of these unshielded portions. The opaque regions can be in a pattern such that the mask has a plurality of transparent regions, the transparent regions corresponding to and being coextensive with the cavities. The shielded areas of the coating thus form a pre-selected pattern corresponding to the desired pattern of knuckles 6 on the papermaking belt 2. Ink 118 can be applied on either surface of mask 110, that is, on either side 110*a* or 110*b*. As can be understood by the description herein, applying the coating 118 on first surface 110*a* requires registered application to ensure that light can penetrate the mask through the region of cavity 116. However, applying the coating 118 onto side 110*b* can be accomplished without registration with a printing process that for example, applies ink from a generally smooth-surface roller to second surface 110*b*, thereby applying ink to second mask plane 154, but not to third (or fourth, fifth, etc.) surface 156. In an embodiment, for example, ink 118 can be applied to second mask plane 154 in a gravure coating process.

Additionally, however, in the present invention the mask provides a dimensionally-stable, three-dimensional mold, so to speak, to form the knuckles 6 of the papermaking belt 2 in a corresponding three-dimensional shape. Prior masks utilized in the formation of papermaking belts, being flat or at the most having a single-elevation, possibly deformable, cavity, are incapable of forming the papermaking belt 2 or the fibrous structures of the present invention. The three-dimensional structure of the mask 110 can be used to form a papermaking belt having substantially the same three-dimensional geometry, as shown in FIGS. 1, 3 and 5, for example.

A source of curing radiation 120, i.e., a light source, radiates through the non-opaque transparent region 112 to cure a portion of the curable resin, which cured portion can include the base portion 26 and extended portion 28 of knuckles 6. Once the mask is removed, and the uncured resin is washed away, the resulting cured resin forms the patterned framework of knuckles 6, as shown, for example in FIGS. 1 and 3. Thus, the dimensions of the mask features, such as the distance DM1 from the second mask plane 154 and third mask plane 158, translate to the dimensions distance between the first surface 30 of knuckle and second surface 32 of knuckle 6, and ultimately to the three-dimensional structures of the paper formed thereon. In an embodiment, the distance in the Z-direction between planes, e.g., distance DM1, and the distance between any additional planes, e.g., DM2 (not shown) of the mask can be from about 0.1 mm to about 1.0 mm, or greater, up to about 5 mm. In an embodiment, therefore, the distance in the Z-direction from first surface 30 to second surface 32 shown in FIG. 5 can be from about 0.1 mm to about 1.0 mm or greater, up to about 5 mm.

The mask 110 of the present invention may have multiple differential opacities, i.e., the mask 110 may have the opaque regions 114 that differ in opacity. Those differential opacities may comprise discrete opacities and/or gradient opacities. As used herein, the term "gradient opacity" means an opacity having a gradually changing intensity. Gradual opacity does not have a defined "border line" therein that would separate one opacity value from the other. That is, the gradient opacity is a non-monotone opacity, wherein the change in opacity in at least one direction is gradually incremental, as opposed to discrete.

One method of constructing the mask 10 having regions of differential opacities comprises printing a transparent film to form a pattern of opaque regions having a certain initial opacity, and then printing the film a second time to form a pattern of opaque regions having another opacity different from the initial opacity. For example, first the film can be printed with ink to form regions of the initial opacity, and then printed again to apply the ink to at least several of the regions already having the initial opacity, thereby increasing the opacity of said several regions. In another method, the differential opacities can be formed in one-step printing, by using a printing roll, such as, for example, a Gravure roll, having a differential-depths pattern therein for receiving ink. During printing, the ink deposited to the transparent film will have regions of differential intensities, reflecting the differential depths of the roll's pattern. Other methods of forming opaque regions can be used in the present invention. Such methods include, but are not limited to, chemical, electromagnetic, laser, heat, lamination of various transmission films, such as by combining multiple layers of film, at least two of the films having a difference in opacity. In one embodiment, the three-dimensional mask can be formed by the lamination of at least two film layers, with at least one being a flat, smooth film, and at least one being formed with a pattern of apertures, such that when laminated the apertures, in effect, form the cavity 116 of mask 110.

The mask 110 can be made in a form of an endless loop (all the details of which are not shown but should be readily apparent to one skilled in the art), or it can be supplied from a supply roll to a take-up roll. As shown in FIG. 10, the mask 110 travels in the direction indicated by a directional arrow D1, turns under the nip roll 111*a* where it can be brought into contact with the surface of the coating 300, travels to a mask guide roll 111*b* in the vicinity of which it can be removed from the contact with the coating 300. The mask 110 can be made of any suitable material which can be provided with opaque and transparent regions. A material in the nature of a flexible optical film is suitable.

The mask can be made the process described herein schematically in FIGS. 13-16, a process which has the capability of making relatively fine cavities 116 in relatively thin films that have the flexibility and optical clarity to be used as a mask 110 in making a papermaking belt 2 of the present invention.

Figure 13:
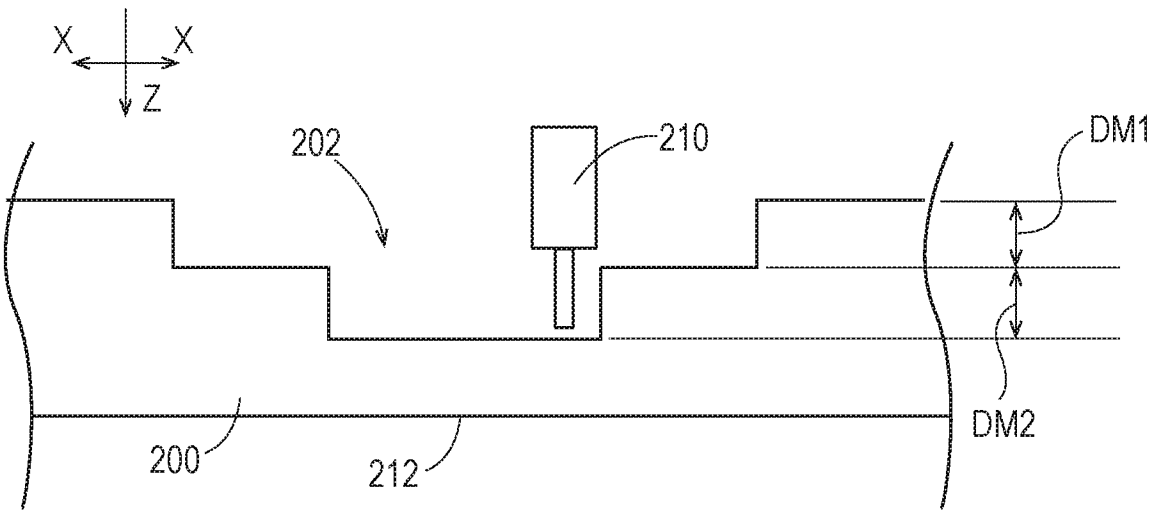
FIG. 13 is a schematic elevation view of machining operation.

The first step of the mask-making process, as shown schematically in FIG. 13, is to machine into metal 200, e.g., brass or aluminum, at least one desired repeating pattern for the shape of the of knuckles 6 of papermaking belt 2. The repeating pattern can be machined, such as by milling using a CNC milling machine 210, to form a master tool 212 exhibiting the relatively small dimensions that will be imparted to the resulting mask. The master tool 212 can be a size determined by the repeating pattern size and in an embodiment can be a rectangular piece being about 2 inches by 4 inches, with a thickness sufficient to exceed the depth of CNC milling and provide physical integrity for electroforming a nickel replica, as described herein. In an embodiment, the CNC milling can be as deep (i.e., the dimension in the Z-direction) as 500 microns (about 20 mils) per "stage" or depth relative to any previous cutting. That is, DM1, which corresponds substantially to the same dimension of the mask in FIG. 12, and DM2 (which is a depth to a fourth surface of cavity 116 as described above, and which cavity can make a knuckle shape to make the paper described with respect to FIG. 20 below) can each be from about 0.1 mm to about 5 mm, or about 0.1 mm to about 4 mm, or from about 0.1 mm to about 3 mm.

Figure 14:
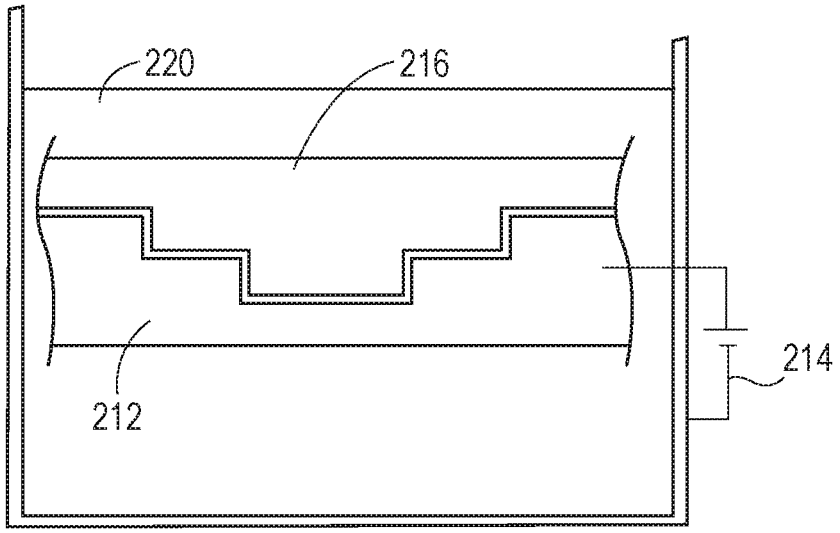
FIG. 14 is a schematic elevation view of nickel plating operation.

Once the desired repeating pattern for the patterned framework is machined into an individual master tool 212, the master tool 212 is immersed in an electrolyte solution 220 and acts as the cathode in an electroforming process 214 to form a nickel replica 216 of the master tool, as depicted schematically in FIG. 14. Once deposited, the nickel replica 216 is removed from the master tool and represents a substantially exact negative image of the desired knuckles 6 in patterned framework repeat unit for papermaking belt 2.

In an embodiment, a mask can be produced by casting an optically clear polymer film onto the nickel replica 216, thus forming a virtually exact copy of the cavity 116 or a plurality of cavities 116 in the film mask. Due to its size, the mask so formed would have limited usefulness in a commercial papermaking operation. But with an opaque ink coating 118 added in a desired pattern, the mask made from casting on a single nickel replica would have all the structural features for usefulness in making a papermaking belt 2 of the present invention. In commercial practice, however, it can be beneficial to use multiple nickel replicas of the master tool 212, each mounted to a rotating drum or belt or other continuous support loop, as discussed below with reference to FIG. 15, with the multiple nickel replicas substantially covering the surface of the rotating drum or belt. The drum or belt size can be sufficient to make a mask having dimensions suitable for the resulting papermaking belt 2. Thus, in an embodiment, a plurality of nickel replicas can be mounted, such as by screwing, joining, adhering, or otherwise connecting onto a drum surface or affixing to seamless belt tool, in a quantity sufficient to cover a rotating drum or belt used to cast masks of the present invention. If desired, the adjacent nickel replicas can be welded together in a manner to have the resulting pattern appear seamless.

A mask can be cast on an embosser apparatus of the type developed by Avery Dennison Corporation, and described in U.S. Pat. No. 6,375,776. The process is briefly repeated below with respect to FIG. 15, which is a re-numbered re-production of FIG. 4 of the above-mentioned '776 patent. The embosser apparatus facilitates a method of continuously forming a multi-layer laminate of thermoplastic polymeric films wherein one surface thereof has a precision pattern of embossed elements thereon and wherein the thermoplastic polymeric films can be dissimilar. A generally cylindrical seamless metal embossing tool with an outer surface having the reverse of the pattern to be formed on the surface of the sheeting can be used. The mask is formed by continuously feeding onto a heated embossing tool a plurality of films, including in an embodiment, a superimposed first resinous film and a first carrier film wherein the first resinous film is pressed against the embossing tool and is heated above its glass transition temperature thereby becoming embossed with the pattern, while the first carrier film remains at a temperature below its glass transition temperature. The first carrier film is then removed, and a second resinous film and second carrier film are superimposed on the unembossed surface of the first resinous film and are heated such that the two resinous films become bonded together. The resulting laminate is then cooled and is stripped from the embossing tool.

Figure 15:
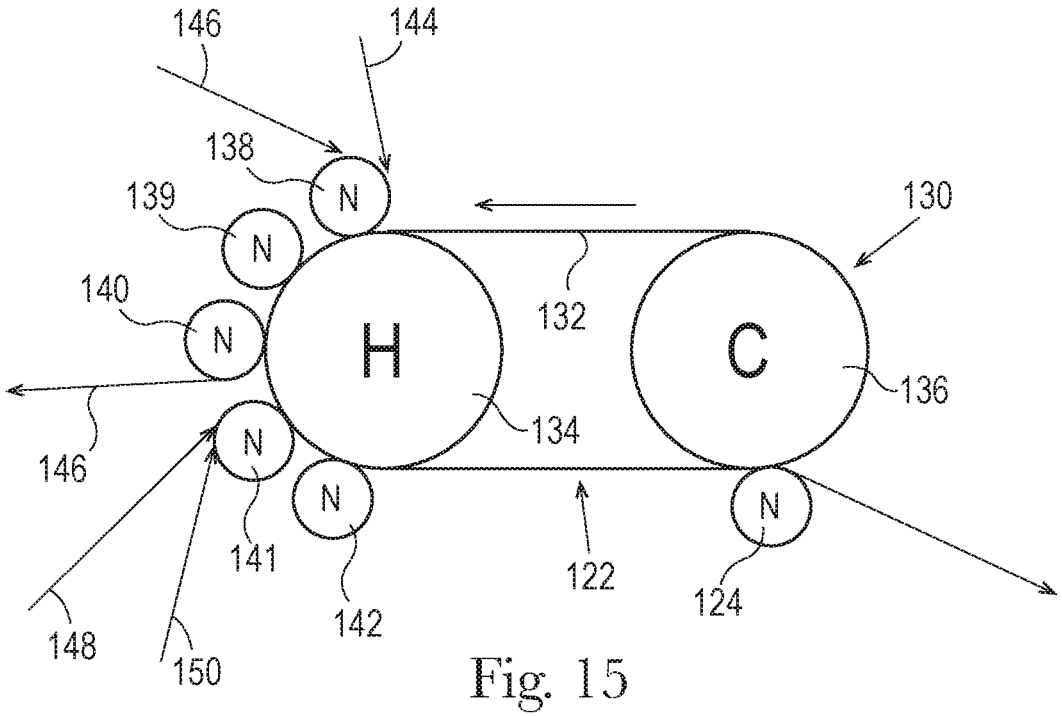
FIG. 15 is a perspective view of a portion of an apparatus for making a mask of the present invention.

Turning now to FIG. 15, an embosser apparatus capable of making the mask of the invention is designated generally by the reference numeral 130. It comprises as a principal component, an endless, seamless metal belt or tool 132 which is rotatable about a heating roller 134 and cooling roller 136. The outer surface of the tool 132 is fabricated with a plurality of closely spaced nickel replicas as described above, which are the reverse of the pattern embossed in the mask 110. Spaced sequentially around the heating roller 134, and preferably through a range of about 180 degrees are a plurality of pressure rollers 138, 139, 140, 141 and 142. Each pressure roller can be formed from silicone rubber with a durometer hardness ranging from Shore A 60 to 90. The endless belt can also be a cylindrical drum on which are mounted closely spaced nickel replicas, as described above.

In accordance with this embodiment of the invention, the mask is constructed with the aid of apparatus 130 by simultaneously feeding at least one lower layer polymer film 144, such as film, described above, together with at least one specialized carrier film 146 into the embosser 130 between pressure roller 138 and the embossing tool 132. The region of the embosser 130 in which embossing tool 132 is in contact with heating roller 134 functions as a heating station. The temperature of the heating roller 134 can be set such that the tool 132 is raised to a temperature above the glass transition temperature of the film 144. When acrylic is used, the heating roller temperature can be about 425° F., although one skilled in the art will recognize that the optimum temperature of the heating roller will depend on environmental conditions and the particular features of the specific embossing machine used. Heating of the roller 134 can be accomplished such as by circulating hot oil axially through the roller 134, or by electrically heating roller 134. The film 144 and carrier 146 pass between pressure rollers 138, 139 and 140 and the tool 132 whereupon the desired pattern of the tool 132 is impressed into the film 144. The carrier film 146 can be selected as to have a glass transition temperature higher than that of the film 144 and, therefore, can remain unaffected by the tool 132 as it passes beneath the pressure rollers 138, 139 and 140.

After the embossed film 144 and carrier film 146 pass roller 140, the carrier film 146 can be separated from superimposed relationship with film 144 and can be moved onto a wind-up roll (not shown). However, the film 144 continues to be adhered to the tool 132 and reaches pressure roller 141 at which point a superimposed top layer of polymer film 148 and a standard carrier film 150 can be joined with the film 144 and together pass beneath the rollers 141 and 142 with the film 144. Because the tool 132 is still in contact with the heating roller 134 at this point, the two polymer films 144 and 148 become bonded together. Like carrier film 146, the carrier film 150 is selected to have a glass transition temperature which is higher than that of both film 144 and film 148. The multi-layer laminate next moves through a cooling station, which can be a generally planar region 122 where the mask is cooled such as by a chilled fluid such as chilled air, and finally exits the embosser 130 at a stripper roller 124, which can strip the mask from the tool (such as disclosed in U.S. Pat. No. 4,601,861).

While lower layer polymer film 144 and top layer polymer film 148 have been illustrated in FIG. 15 for the sake of simplicity as each comprising a single film layer, the instant invention is not so limited. Films 144 and 148 can each comprise a plurality of films. For example, film 144 can comprise a plurality of layers of different polycarbonate films, which layers may have different additives such as colorants and may otherwise differ somewhat from one another. The various layers of film 144 can be pre-laminated together prior to being fed into apparatus 130, or the layers can be fed into apparatus 130 as separate webs and laminated together as they pass between the nip rollers 138, 139, 140 and heating roller 134. In an embodiment, the plurality of films that make up film 144 can have substantially equivalent refractive indexes and UV transmittance properties. Similarly, film 148 can comprise a plurality of layers of, for example, different acrylic films, which can be either pre-laminated together, or fed into the apparatus 130 as separate webs and laminated together as they pass between the nip rollers 141, 142 and heating roller 134. Hence, good optical performance and UV transmittance and flexibility can be achieved even if dissimilar polymeric films comprise film 148, provided that the interface between each film layer is optically smooth.

Figure 16:
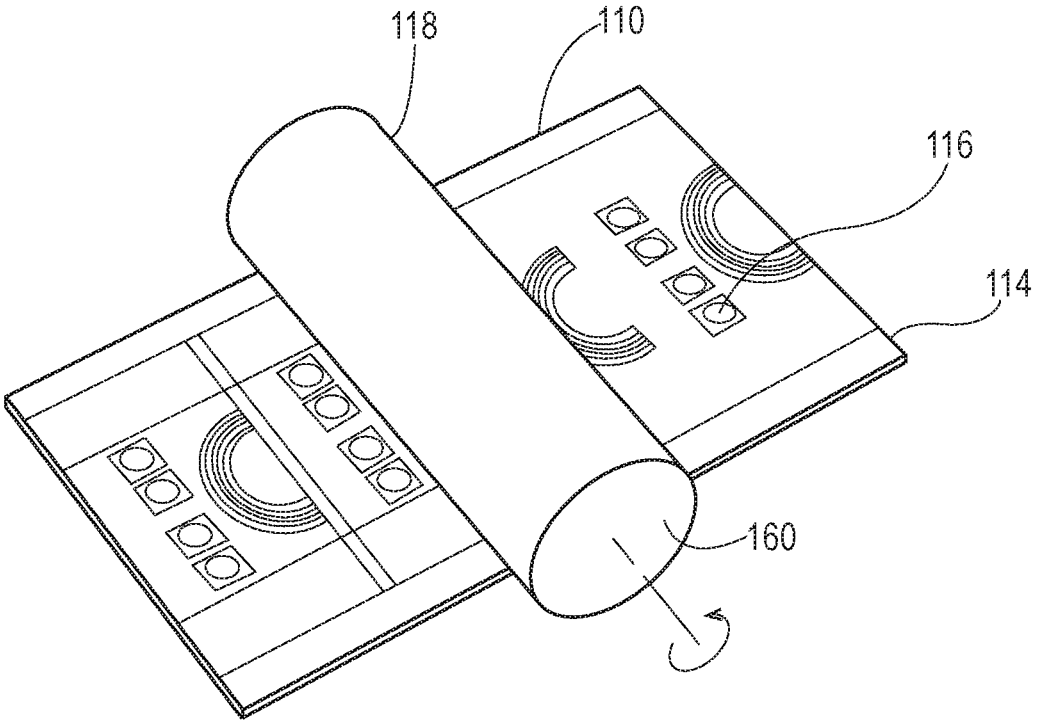
FIG. 16 is a perspective view of an apparatus and method for coating a mask of the present invention.

Once the three-dimensional mask 110 is made on the apparatus described with respect to FIG. 15, the film can be selectively coated with an opaque coating to provide for the opaque regions 14 that mask light from the light curable resin during manufacture of the papermaking belt 2. The opaque coating can be an opaque ink applied in known manners, including by hand with an applicator such as a brush or wiper. As shown in FIG. 16, one method is to apply ink to a roll 160, such as a printing roll, and roll over the mask, thus depositing ink on the contacting areas of the mask. Cavities 116, being at a lower elevation during this printing process, would not receive ink, and thus would remain substantially transparent.

One advantage of the mask of the present invention is that it facilitates single-pass formation of three-dimensional structures on a patterned framework 20 of papermaking belt 2. This provides commercial advantages in that a papermaking belt 2 having a three-dimensional patterned framework can be made more economically. Further, the mask of the present invention provides for better registration of the three-dimensional aspects of the patterned framework on papermaking belt 2. These features of the mask, and the papermaking belt 2 produced by the mask, translate into a fibrous structure having three-dimensional features that improve the absorbency and cleaning performance of the fibrous structure.

Process for Making Fibrous Structure

With reference to FIG. 17, one exemplary embodiment of the process for producing the fibrous structure 500 of the present invention is described below. In the description below, the papermaking belt 211 can be the papermaking belt 2 described hererin made by curing UV-curable resin on a reinforcing member 8 utilizing the mask of the invention described above. The process disclosed herein is a wet-laying papermaking process. However, it is contemplated that the belt of the present invention can find utility in making air-laid substrates, and other processed known in the art of manufacturing nonwoven materials.

The present invention contemplates the use of a variety of fibers, such as, for example, papermaking cellulosic fibers, synthetic fibers, or any other suitable fibers, and any combination thereof. Papermaking fibers useful in the present invention include cellulosic fibers commonly known as wood pulp fibers. Fibers derived from soft woods (gymnosperms or coniferous trees) and hard woods (angiosperms or deciduous trees) are contemplated for use in this invention. The particular species of tree from which the fibers are derived is immaterial. The hardwood and softwood fibers can be blended, or alternatively, can be deposited in layers to provide a stratified web. U.S. Pat. No. 4,300,981 issued Nov. 17, 1981 to Carstens and U.S. Pat. No. 3,994,771 issued Nov. 30, 1976 to Morgan et al. are each incorporated herein by reference for the purpose of disclosing layering of hardwood and softwood fibers.

The wood pulp fibers can be produced from the native wood by any convenient pulping process. Chemical processes such as sulfite, sulfate (including the Kraft) and soda processes are suitable. Mechanical processes such as thermomechanical (or Asplund) processes are also suitable. In addition, the various semi-chemical and chemi-mechanical processes can be used. Bleached as well as unbleached fibers are contemplated for use. When the fibrous web of this invention is intended for use in absorbent products such as paper towels, bleached northern softwood Kraft pulp fibers may be used. Wood pulps useful herein include chemical pulps such as Kraft, sulfite and sulfate pulps as well as mechanical pulps including for example, ground wood, thermomechanical pulps and Chemi-ThermoMechanical Pulp (CTMP). Pulps derived from both deciduous and coniferous trees can be used.

In addition to the various wood pulp fibers, other cellulosic fibers such as cotton linters, rayon, and bagasse can be used in this invention. Synthetic fibers, such as polymeric fibers, can also be used. Elastomeric polymers, polypropylene, polyethylene, polyester, polyolefin, and nylon, can be used. The polymeric fibers can be produced by spunbond processes, meltblown processes, and other suitable methods known in the art. It is believed that thin, long, and continuous fibers produces by spunbond and meltblown processes may be beneficially used in the fibrous structure of the present invention, because such fibers are believed to be easily deflectable into the pockets of the papermaking belt of the present invention.

The paper furnish can comprise a variety of additives, including but not limited to fiber binder materials, such as wet strength binder materials, dry strength binder materials, and chemical softening compositions. Suitable wet strength binders include, but are not limited to, materials such as polyamide-epichlorohydrin resins sold under the trade name of KYMENE™ 557H by Hercules Inc., Wilmington, Del. Suitable temporary wet strength binders include but are not limited to synthetic polyacrylates. A suitable temporary wet strength binder is PAREZ™ 750 marketed by American Cyanamid of Stanford, Conn. Suitable dry strength binders include materials such as carboxymethyl cellulose and cationic polymers such as ACCO™ 711. The CYPRO/ACCO family of dry strength materials are available from CYTEC of Kalamazoo, Mich.

The paper furnish can comprise a debonding agent to inhibit formation of some fiber to fiber bonds as the web is dried. The debonding agent, in combination with the energy provided to the web by the dry creping process, results in a portion of the web being debulked. In one embodiment, the debonding agent can be applied to fibers forming an intermediate fiber layer positioned between two or more layers. The intermediate layer acts as a debonding layer between outer layers of fibers. The creping energy can therefore debulk a portion of the web along the debonding layer. Suitable debonding agents include chemical softening compositions such as those disclosed in U.S. Pat. No. 5,279,767 issued Jan. 18, 1994 to Phan et al., the disclosure of which is incorporated herein by reference Suitable biodegradable chemical softening compositions are disclosed in U.S. Pat. No. 5,312,522 issued May 17, 1994 to Phan et al. U.S. Pat. Nos. 5,279,767 and 5,312,522, the disclosures of which are incorporated herein by reference. Such chemical softening compositions can be used as debonding agents for inhibiting fiber to fiber bonding in one or more layers of the fibers making up the web. One suitable softener for providing debonding of fibers in one or more layers of fibers forming the web 20 is a papermaking additive comprising DiEster Di (Touch Hardened) Tallow Dimethyl Ammonium Chloride. A suitable softener is ADOGEN® brand papermaking additive available from Witco Company of Greenwich, Conn.

The embryonic web can be typically prepared from an aqueous dispersion of papermaking fibers, though dispersions in liquids other than water can be used. The fibers are dispersed in the carrier liquid to have a consistency of from about 0.1 to about 0.3 percent. Alternatively, and without being limited by theory, it is believed that the present invention is applicable to moist forming operations where the fibers are dispersed in a carrier liquid to have a consistency less than about 50 percent.

Conventional papermaking fibers can be used and the aqueous dispersion can be formed in conventional ways. Conventional papermaking equipment and processes can be used to form the embryonic web on the Fourdrinier wire. The association of the embryonic web with the papermaking belt 211 can be accomplished by simple transfer of the web between two moving endless belts as assisted by differential fluid pressure. The fibers may be deflected into the papermaking belt 211 by the application of differential fluid pressure induced by an applied vacuum. Any technique, such as the use of a Yankee drum dryer, can be used to dry the intermediate web. Foreshortening can be accomplished by any conventional technique such as creping.

The plurality of fibers can also be supplied in the form of a moistened fibrous web (not shown), which should preferably be in a condition in which portions of the web could be effectively deflected into the deflection conduits of the papermaking belt and the void spaces formed between the suspended portions and the X-Y plane.

In FIG. 17, the embryonic web comprising fibers 501 is transferred from a forming wire to the papermaking belt 211 by a vacuum pick-up shoe 218*a*. Alternatively or additionally, a plurality of fibers, or fibrous slurry, can be deposited to the papermaking belt 211 directly (not shown) from a headbox or otherwise. The papermaking belt 211 in the form of an endless belt travels about rolls 219*a*, 219*b*, 219*k*, 219*c*, 219*d*, 219*e*, and 19*f* in the direction schematically indicated by the directional arrow "B."

Then, a portion of the fibers 501 is deflected into the deflection portion of the papermaking belt such as to cause some of the deflected fibers or portions thereof to be disposed within the deflection conduits of the papermaking belt, and therefore, to take the shape of the knuckles 6, as shown in FIG. 18. Depending on the process, mechanical, as well as fluid pressure differential, alone or in combination, can be utilized to deflect a portion of the fibers 501 into the deflection conduits of the papermaking belt. For example, in a through-air drying process shown in FIG. 17, a vacuum apparatus 218*b*, applies a fluid pressure differential to the embryonic web disposed on the papermaking belt 211, thereby deflecting fibers into the deflection conduits of the papermaking belt 211. The process of deflection may be continued as another vacuum apparatus 218*c* applies additional vacuum pressure (or, alternatively, positive pressure) to even further deflect the fibers into the deflection conduits of the papermaking belt 211.

Finally, a partly-formed fibrous structure associated with the papermaking belt 211 can be separated from the papermaking belt to form the fibrous structure 500 of the present invention.

The process may further comprise a step of impressing the papermaking belt 211 having the fibers therein against a pressing surface, such as, for example, a surface of a Yankee drying drum 228, thereby densifying portions of web. In FIG. 17, the step of impressing the web against the Yankee drying drum is performed by using the pressure roll 219*k*. This also typically includes a step of drying the fibrous structure.

Fibrous Structure

When formed utilizing a papermaking belt 2 having a knuckle pattern of the invention, the fibrous structure can exhibit features corresponding to the features of the knuckles of the papermaking belt, as shown in FIG. 18. FIG. 18 shows how a fibrous structure 500 can take the form of the knuckles of the papermaking belt, the outline of which is represented as dashed line 530. As shown, a fibrous structure, which can be a bath tissue, facial tissue, paper towel, or other cellulosic sanitary tissue product (or non-cellulosic, synthetic, nonwoven materials) can be made up of fibers 501 which have been deposited on a papermaking belt having a knuckle configuration as described herein, and represented by nonlimiting example in FIG. 18 as having a plurality of surfaces substantially parallel to an X-Y plane, and separated by a distance in the Z-direction. The resulting fibrous structure can exhibit a substantially identical, albeit less well defined due to the nature of fibrous webs. As shown in a representative potential configuration in FIG. 18, a fibrous structure can exhibit a first surface 510 in plane 516 which has a first projected area AF1; a second surface 512 in plane 518 which has a second projected area AF2; and a third surface 514 in plane 520 which has a third projected area AF3. As with the description above relating to the mask and knuckles made thereby, the relationship of projected areas of the various surfaces of the fibrous structure follow the same pattern. That is, the projected area of each successive surface in a Z-direction from a lower side 540 of the fibrous structure is less than the projected area of any surfaces closer to the lower side 540 of the fibrous structure 500. Thus, in FIG. 18, AF3<AF2<AF1. Moreover, each successive projected area in a Z-direction from lower side 540 is bounded by the projected area any surfaces closer to the lower side 540 of the fibrous structure 500. A fibrous structure of the present invention therefore can have greater surface area per sheet due to the multiple elevations of out-of-plane three-dimensional features. The specific structure of the out-of-plane three-dimensional features can enable better cleaning and better absorbency.

Figure 19:
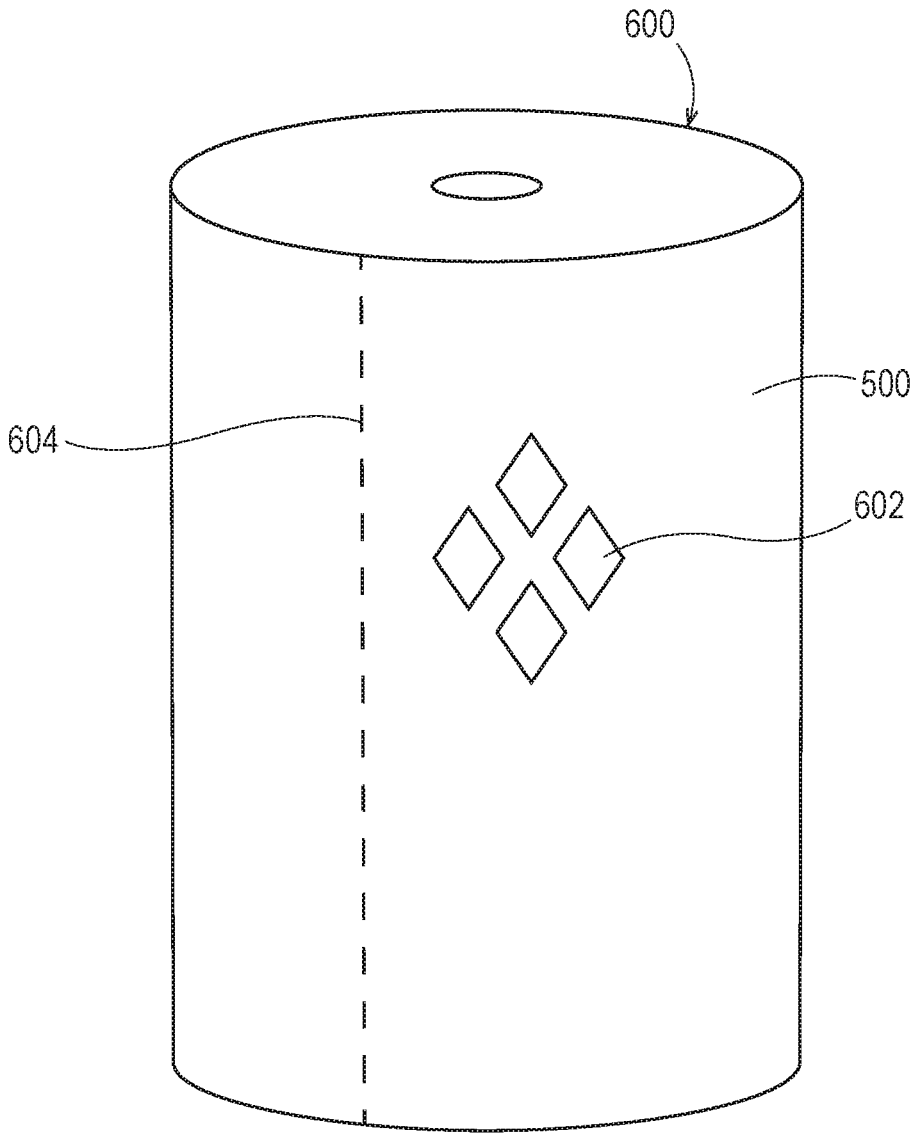
FIG. 19 is an elevation view of a roll of fibrous structure of the present invention.

The fibrous structure can be further processed and converted to consumer goods, for example by joining together single plies to make a multi-ply fibrous structure, and/or by embossing to provided for an embossed fibrous structure, and/or by supplying in roll form to provide for a rolled fibrous structure which can be a roll of sheets separated by perforations as is commonly known in the field of bath tissue and paper towels. In an embodiment, the fibrous structure is a roll of embossed, multi-ply fibrous structure in the form of bath tissue or paper towels, as shown in FIG. 19. FIG. 19 shows a roll 600 of fibrous structure 500 of the present invention, which can be a multi-ply paper towel, for example. The fibrous structure can have embossments 602 on the surface of at least one ply, and the rolled product can have a plurality of spaced lines of perforations 604 separating individual sheets.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application is hereby incorporated herein by reference in its entirety unless expressly excluded or otherwise limited. The citation of any document is not an admission that it is prior art with respect to any embodiment disclosed or claimed herein or that it alone, or in any combination with any other reference or references, teaches, suggests or discloses any such embodiment. Further, to the extent that any meaning or definition of a term in this document conflicts with any meaning or definition of the same term in a document incorporated by reference, the meaning or definition assigned to that term in this document shall govern.

While particular embodiments of the present disclosure have been illustrated and described, it would be obvious to those skilled in the art that various other changes and modifications can be made without departing from the spirit and scope of the present disclosure. It is therefore intended to cover in the appended claims all such changes and modifications that are within the scope of this disclosure.

The invention claimed is:

1. A textured mask comprising a film, the film having a first substantially continuously flat surface lying in a first plane and a second surface opposite the first surface lying in a second plane substantially parallel to the first plane, the second surface being interrupted by a plurality of cavities, each of the cavities having a first depth defined by a third surface lying in a third plane substantially parallel to the first and second planes, the depth being at a distance of from about 0.1 mm to about 5 mm from the second plane; and, wherein the textured mask is at least partially coated with an opaque masking agent, wherein the opaque masking agent is applied to the first substantially continuously flat surface, wherein portions of the textured mask coated with the opaque masking agent are opaque to UV-light radiation, and wherein portions of the textured mask that are not coated with the opaque masking agent remain transparent to UV-light radiation and include the portions corresponding to the plurality of cavities.

2. The textured mask of claim 1, wherein the depth is an average depth.

3. The textured mask of claim 1, wherein the opaque masking agent is an ink.

4. The textured mask of claim 1 wherein each cavity has an equal depth, the depth being at a distance of from about 0.1 mm to about 5 mm from the second surface.

5. A textured mask comprising a film, the film having a first substantially continuously flat surface lying in a first plane and a second surface opposite the first surface lying in a second plane substantially parallel to the first plane, the second surface being interrupted by a plurality of cavities, wherein an opaque masking agent is applied to the first substantially continuously flat surface, and wherein the textured mask has opaque regions and transparent regions, the transparent regions corresponding to and being coextensive with the cavities, wherein the opaque regions comprise the opaque masking agent and the transparent regions do not comprise the opaque masking agent.

6. The textured mask of claim 5, wherein the textured mask is partially coated with said opaque masking agent to form the opaque regions and transparent regions.

7. The textured mask of claim 6, wherein the opaque masking agent is an ink.

8. The textured mask of claim 5, wherein the opaque regions of the mask are opaque to UV-light radiation and the transparent regions of the mask are transparent to UV-light radiation.

9. The textured mask of claim 5, wherein each of the cavities has a first depth defined by a third surface lying in a third plane substantially parallel to the first and second planes, the first depth being at a distance of from about 0.1 mm to about 5 mm from the second plane.

10. The textured mask of claim 9, wherein the first depth is an average depth.

11. The textured mask of claim 9, wherein each cavity has an maximum depth, the maximum depth being at a distance of from about 0.5 mm to about 10 mm from the second surface.

* * * * *